US010466607B2

(12) United States Patent
Koide et al.

(10) Patent No.: US 10,466,607 B2
(45) Date of Patent: Nov. 5, 2019

(54) IMAGE FORMING APPARATUS

(71) Applicant: FUJI XEROX CO., LTD., Tokyo (JP)

(72) Inventors: Takafumi Koide, Kanagawa (JP); Masataka Kuribayashi, Kanagawa (JP); Yusuke Fukuda, Kanagawa (JP); Katsuyuki Kitajima, Kanagawa (JP); Teppei Yawada, Kanagawa (JP); Shota Oshima, Kanagawa (JP); Masahiro Uchida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/943,268

(22) Filed: Apr. 2, 2018

(65) Prior Publication Data

US 2019/0086827 A1 Mar. 21, 2019

(30) Foreign Application Priority Data

Sep. 21, 2017 (JP) ..... 2017-181589

(51) Int. Cl.

| | |
|---|---|
| ***G03G 9/08*** | (2006.01) |
| ***G03G 9/087*** | (2006.01) |
| ***G03G 15/08*** | (2006.01) |
| ***G03G 15/16*** | (2006.01) |

(52) U.S. Cl.

CPC ..... *G03G 9/08755* (2013.01); *G03G 9/0821* (2013.01); *G03G 9/0823* (2013.01); *G03G 9/08795* (2013.01); *G03G 9/08797* (2013.01); *G03G 15/08* (2013.01); *G03G 15/1605* (2013.01)

(58) Field of Classification Search

CPC ..... G03G 9/08755; G03G 9/0821; G03G 9/0823; G03G 15/08; G03G 15/1605

See application file for complete search history.

(56) References Cited

U.S. PATENT DOCUMENTS 6,980,760 B2 * 12/2005 Okamoto ..... G03G 15/0131 399/227
2011/0281211 A1 * 11/2011 Konno ..... G03G 9/0819 430/109.3

(Continued)

FOREIGN PATENT DOCUMENTS

JP 2000-056504 A 2/2000
JP 2011-39155 A 2/2011

*Primary Examiner* — Thorl Chea
(74) *Attorney, Agent, or Firm* — Oliff PLC

(57) ABSTRACT

An image forming apparatus includes an image holding member, a charging device that charges a surface of the image holding member, an electrostatic charge image forming device that forms an electrostatic charge image on the charged surface of the image holding member, a developing device that has an electrostatic charge image developer containing an electrostatic charge image developing toner and that develops the electrostatic charge image to form a toner image on the surface of the image holding member, and a transfer device that transfers the toner image onto a recording medium, wherein the transfer device includes a belt member and a transfer member, the belt member has an outer surface that contacts the image holding member, and the belt member is winding around the image holding member and the transfer member; and the toner has a binder resin containing an amorphous polyester resin.

16 Claims, 7 Drawing Sheets

(56) References Cited

U.S. PATENT DOCUMENTS

2013/0252165 A1* 9/2013 Anno ..... G03G 9/0806
430/108.11
2014/0219680 A1* 8/2014 Hagiwara ..... G03G 15/0216
399/159

* cited by examiner

IMAGE FORMING APPARATUS

CROSS-REFERENCE TO RELATED APPLICATIONS

This application is based on and claims priority under 35 USC 119 from Japanese Patent Application No. 2017-181589 filed Sep. 21, 2017.

BACKGROUND

(i) Technical Field

The present invention relates to an image forming apparatus.

(ii) Related Art

An electrophotographic process for forming an image, for example, includes charging the surface of an image holding member, forming an electrostatic charge image on this surface of the image holding member on the basis of image information, developing the electrostatic charge image with a developer containing toner to form a toner image, and transferring and fixing the toner image to the surface of a recording medium.

SUMMARY

According to an aspect of the invention, there is provided an image forming apparatus including an image holding member, a charging device that charges a surface of the image holding member, an electrostatic charge image forming device that forms an electrostatic charge image on the charged surface of the image holding member, a developing device that has an electrostatic charge image developer containing an electrostatic charge image developing toner and that develops the electrostatic charge image to form a toner image on the surface of the image holding member, and a transfer device that transfers the toner image onto a recording medium, wherein the transfer device includes a belt member and a transfer member, the belt member has an outer surface that contacts the image holding member, and the belt member is winding around the image holding member and the transfer member; the toner has a binder resin containing an amorphous polyester resin; a tetrahydrofuran-soluble component of the toner has a weight average molecular weight Mw and number average molecular weight Mn determined from gel permeation chromatography, and the Mw is in the range of 25,000 to 60,000, and Mw/Mn is in the range of 5 to 10; and the toner has absorbance measured by infrared absorption spectrometry, the ratio of absorbance for a wavelength of 1500 $cm^{-1}$ to absorbance for a wavelength of 720 $cm^{-1}$ is 0.6 or less, and the ratio of absorbance for a wavelength of 820 $cm^{-1}$ to absorbance for a wavelength of 720 $cm^{-1}$ is 0.4 or less.

BRIEF DESCRIPTION OF THE DRAWINGS

Exemplary embodiment of the present invention will be described in detail based on the following figures, wherein.

DETAILED DESCRIPTION

Figure 1:
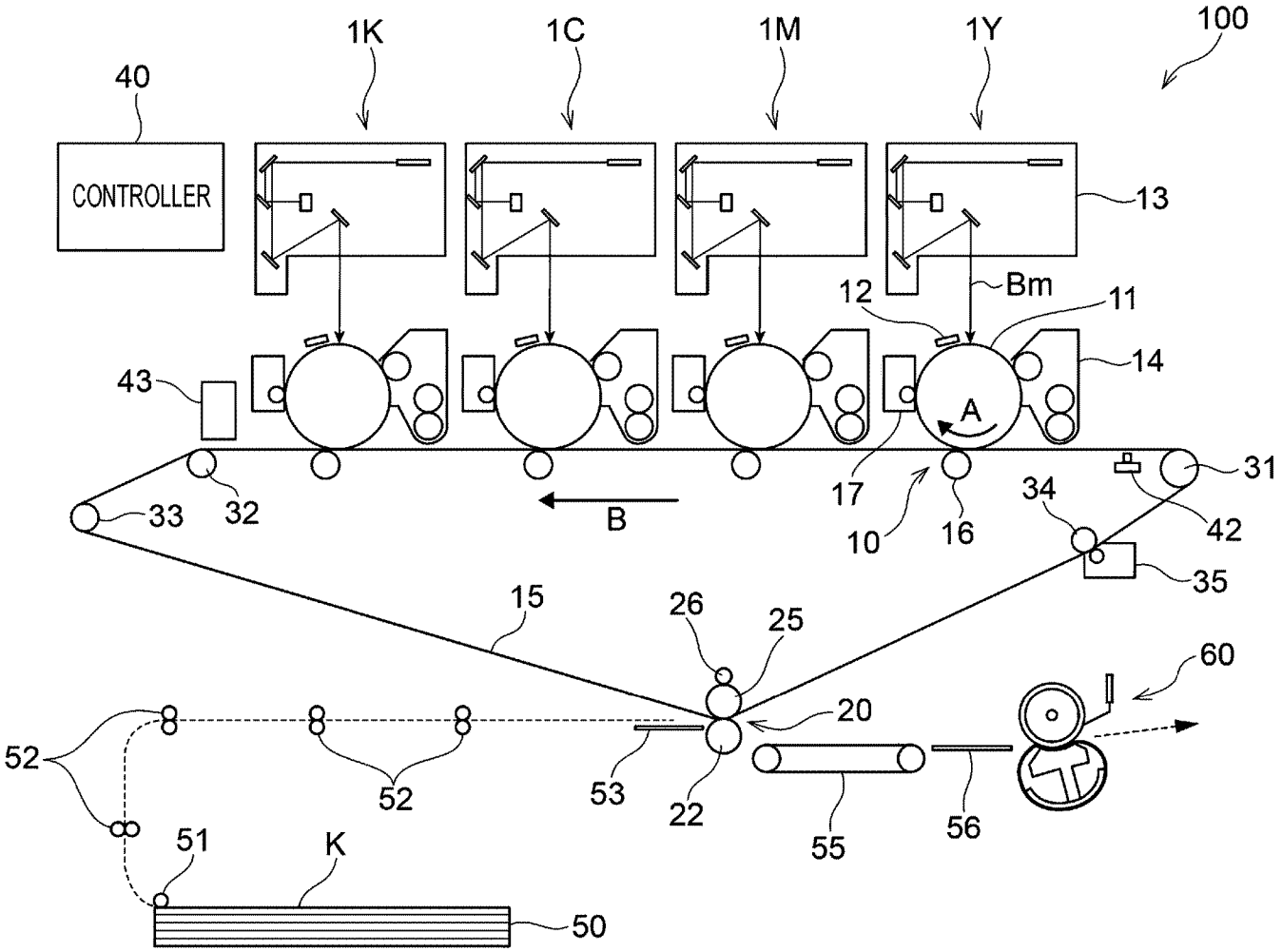
FIG. 1 schematically illustrates an example of the structure of an image forming apparatus according to an exemplary embodiment.

An exemplary embodiment that is an example of the invention will now be described in detail.

Image Forming Apparatus

An image forming apparatus according to an exemplary embodiment includes an image holding member, a charging unit that charges the surface of the image holding member, an electrostatic charge image forming unit that forms an electrostatic charge image on the charged surface of the image holding member, a developing unit that has an electrostatic charge image developer containing toner and that develops the electrostatic charge image on the surface of the image holding member with the electrostatic charge image developer to form a toner image, and a transfer unit that transfers the toner image formed on the surface of the image holding member to the surface of a recording medium.

The transfer unit includes a belt member and at least one transfer member; the belt member has an outer surface that contacts the image holding member, and the belt member is winding around the image holding member and the transfer member.

The toner (specific toner) contains an amorphous polyester resin as a binder resin and toner particles. When the tetrahydrofuran-soluble component of the toner particles (also referred to as "THF-soluble component") is analyzed by gel permeation chromatography (GPC) to determine a weight average molecular weight Mw and a number average molecular weight Mn, Mw is in the range of 25,000 to 60,000, and Mw/Mn is in the range of 5 to 10. In addition, when the toner particles are analyzed by infrared absorption spectrometry, the ratio of absorbance for a wavelength of 1500 $cm^{-1}$ to absorbance for a wavelength of 720 $cm^{-1}$ is 0.6 or less, and the ratio of absorbance for a wavelength of 820 $cm^{-1}$ to absorbance for a wavelength of 720 $cm^{-1}$ is 0.4 or less.

In electrophotographic image forming apparatuses, an electrostatic charge image formed on the surface of the image holding member is developed with a developer containing toner to form a toner image, the toner image is transferred from the image holding member to the surface of a recording medium, and then the toner image is fixed to form an image on the recording medium. Known techniques for transferring a toner image to the surface of a recording medium include a technique in which a toner image is directly transferred from the image holding member to the surface of a recording medium (direct transfer) and a technique in which a toner image is subjected to first transfer from the image holding member to an intermediate transfer body and in which the toner image on the intermediate transfer body is subjected to second transfer to the surface of a recording medium (intermediate transfer) In the direct transfer, a belt member (recording medium transporting belt) is used as a recording medium transporting unit for transporting a recording medium to a transfer position at which the toner image formed on the surface of the image holding member is transferred to the recording medium; in the intermediate transfer, a belt member (intermediate transfer belt) is used as the intermediate transfer body.

The term "specific toner" refers to toner containing toner particles of which analysis by infrared absorption spectrometry shows that the ratio of absorbance for a wavelength of 1500 $cm^{-1}$ to absorbance for a wavelength of 720 $cm^{-1}$ is 0.6 or less and that the ratio of absorbance for a wavelength of 820 $cm^{-1}$ to absorbance for a wavelength of 720 $cm^{-1}$ is 0.4 or less. Such infrared absorption spectrum characteristics of the toner particles mean that the amorphous polyester resin used as a binder resin does not contain an alkylene oxide adduct of bisphenol A (such as ethylene oxide adduct of bisphenol A, propylene oxide adduct of bisphenol A, or ethylene oxide-propylene oxide adduct of bisphenol A) as a polyhydric alcohol or contain it in a slight amount if any.

In order to enhance the fixability of a fixed image in which the specific toner is used, the weight average molecular weight Mw and number average molecular weight Mn of a tetrahydrofuran-soluble component contained in the toner particles, which are determined by gel permeation chromatography, are suitably adjusted to be as follows: Mw is from 25,000 to 60,000, and Mw/Mn is from 5 to 10. In particular, it is suitable that a non-cross-linked binder resin component principally have such molecular weight characteristics.

Specifically, in the case where the Mw is less than 25000, hot offset (phenomenon in which toner unnecessarily melts and adheres to fixing members) is likely to occur in a fixing process; in the case where the Mw is greater than 60000, the lower limit of the fixing temperature is likely to be enhanced. In the case where the Mw/Mn is greater than 10, the resins have a difference in meltability, which results in that a fixed image is likely to have unevenness. Adjusting the Mw/Mn to be less than 5 is difficult for the convenience of a production process.

The specific toner (toner particles thereof) having the above-mentioned molecular weight characteristics enables an enhancement in the fixability of an image.

Use of the specific toner, however, leads to a reduction in transferability in some cases. The cause thereof is speculated as follows. The specific toner has a high moisture absorbing property attributed to the amorphous polyester resin. Hence, moisture absorption causes the charging properties of the specific toner to be reduced; in particular, charging properties are greatly reduced in a high temperature and high humidity environment (for example, temperature of 35° C. and humidity of 85%). The reduced charging properties of the specific toner leads to unsuccessful transfer of a toner image from the image holding member in some cases.

In view of this circumstance, the transfer unit used in the image forming apparatus of the exemplary embodiment includes a belt member and at least one transfer member; the belt member has an outer surface that contacts the image holding member, and the belt member is winding around the image holding member and the transfer member.

This structure enables formation of a wider nip (contact region with a wider contact area) as compared with the case where a belt member does not wind around the transfer member and the image holding member.

In particular, in the transfer unit of direct transfer, a wider nip is formed at the transfer position at which a toner image is transferred from the image holding member to a recording medium, and the toner image can therefore exist between the image holding member and the recording medium on the recording medium transporting belt for a longer duration of time. In the transfer unit of intermediate transfer, a wider nip is formed at the first transfer position at which a toner image is transferred from the image holding member to the intermediate transfer belt, and the toner image can therefore exist between the image holding member and the intermediate transfer belt for a longer duration of time.

Thus, a toner image can be well transferred from the image holding member to the surface of a recording medium [from the image holding member to a recording medium in direct transfer and from the image holding member to the surface of the intermediate transfer body (intermediate transfer belt) in intermediate transfer, namely first transfer], so that transferability is enhanced.

Accordingly, in the image forming apparatus of the exemplary embodiment, the transferability of a toner image is enhanced.

Width of Nip

In the transfer unit in the exemplary embodiment, the nip formed in the contact region in which the image holding member contacts the belt member has a width (length of contact region in circumferential direction of belt member, namely in driving direction thereof) of preferably 5 mm or more, and more preferably 20 mm or more.

The width of the nip in such a range enables a toner image to exist between the image holding member and the belt member for a longer duration of time, so that the transferability of the toner image can be easily enhanced.

The upper limit of the width of the nip is preferably up to 60 mm, and more preferably up to 40 mm in order to reduce a torque increase.

The structure of the image forming apparatus of the exemplary embodiment will now be described in detail.

Structure of Image Forming Apparatus

An image forming apparatus of the exemplary embodiment includes an image holding member, a charging unit that charges the surface of the image holding member, an electrostatic charge image forming unit that forms an electrostatic charge image on the charged surface of the image holding member, a developing unit that has an electrostatic charge image developer containing toner and that develops the electrostatic charge image on the surface of the image holding member with the electrostatic charge image developer to form a toner image, and a transfer unit that transfers the toner image formed on the surface of the image holding member to the surface of a recording medium.

The transfer unit includes a belt member and a transfer member; the belt member has an outer surface that contacts the image holding member, and the belt member is winding around the transfer member and the image holding member. Thus, in the transfer unit, part of the belt member contacts part of the image holding member along the circumference of the image holding member.

In the transfer unit in the exemplary embodiment, the belt member may be used in any form; for example, the belt member can be used as an intermediate transfer belt in a transfer unit of an intermediate transfer type or as a recording medium transporting belt in a transfer unit of a direct transfer type.

In the case where the belt member is used as the intermediate transfer belt, the transfer unit includes the intermediate transfer belt (belt member), a first transfer member that transfers a toner image formed on the surface of the image holding member to the surface of the intermediate transfer belt (first transfer), and a second transfer member that transfers the toner image transferred to the surface of the intermediate transfer belt to a recording medium (second transfer).

In the case where the belt member is used as the recording medium transporting belt, the transfer unit includes the recording medium transporting belt (belt member) that transports a recording medium to the transfer position at which a toner image formed on the surface of the image holding member is transferred to the recording medium and the transfer member that transfers the toner image formed on the surface of the image holding member to the surface of the recording medium.

The belt member in the transfer unit may have a cleaning unit in which a cleaning member (such as cleaning blade) contacts the belt member to clean the outer surface thereof.

Examples of the image forming apparatus of the exemplary embodiment include a general monocolor image forming apparatus of which the developing device has only toner of a single color, a color image forming apparatus of which toner images held on the image holding member are repeatedly subjected to first transfer to the intermediate transfer body in sequence, and a tandem-type color image forming apparatus of which multiple image holding members having developing devices for different colors are disposed in line on the intermediate transfer body.

The image forming apparatus of the exemplary embodiment will now be described with reference to the drawings.

Structure of Image Forming Apparatus (First Example)

An example of the image forming apparatus in which the belt member in the transfer unit is an intermediate transfer body will be described.

FIG. 1 schematically illustrates an example of the structure of the image forming apparatus of the exemplary embodiment.

As illustrated in FIG. 1, an image forming apparatus 100 according to the exemplary embodiment is, for example, an intermediate transfer type image forming apparatus that is a so-called tandem type. The image forming apparatus 100 includes image forming units 1Y, 1M, 1C, and 1K that individually form toner images of different color components by an electrophotographic technique; first transfer parts 10 that transfer the toner images of different color components formed by the image forming units 1Y, 1M, 1C, and 1K to an intermediate transfer belt 15 (example of belt member) in sequence (first transfer); a second transfer part 20 that collectively transfers the toner images transferred onto the intermediate transfer belt 15 to paper K as a recording medium (second transfer); and a fixing device 60 (example of fixing unit) that fixes the images subjected to the second transfer onto the paper K. The image forming apparatus 100 further includes a controller 40 that controls the operation of each device (part).

Each of the image forming units 1Y, 1M, 1C, and 1K of the image forming apparatus 100 has a photoreceptor 11 (example of image holding member) that rotates in the direction indicated by the arrow A and that holds a toner image formed on the surface thereof.

In the vicinity of the photoreceptor 11, a charger 12 that is an example of the charging unit is provided to charge the photoreceptor 11, and a laser exposure unit 13 that is an example of the electrostatic charge image forming unit is provided to write an electrostatic charge image on the photoreceptor 11 (exposure beam is indicated by the sign Bm in the drawing).

Also in the vicinity of the photoreceptor 11, a developing unit 14 that has toner of a corresponding color component is provided as an example of the developing unit to turn the electrostatic charge image on the photoreceptor 11 into a visible image with the toner. The above-mentioned specific toner is used as toner of at least one of the color components. In the exemplary embodiment, it is suitable that the toner of each of the color components be the specific toner.

A first transfer roller 16 (example of transfer member) is provided to transfer the toner image of a corresponding color component on the photoreceptor 11 to the intermediate transfer belt 15 at the first transfer part 10.

Offsetting of the first transfer roller 16 will now be described.

Figure 2:
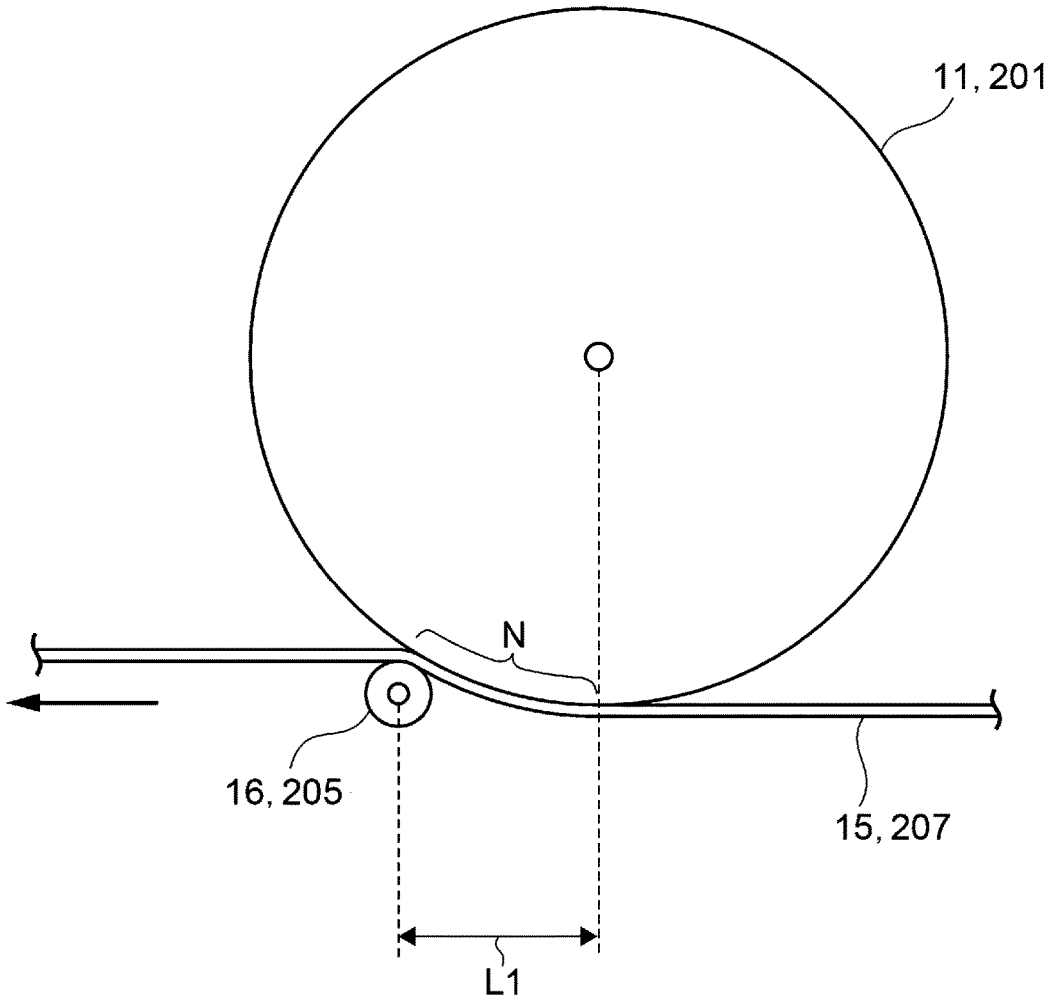
FIG. 2 schematically illustrates an example of the positional relationship between an image holding member and a transfer member in the image forming apparatus according to the exemplary embodiment.

In the image forming apparatus 100 illustrated in FIG. 1, the first transfer roller 16 is out of alignment (offset) in the driving direction of the intermediate transfer belt 15. Specifically, when the position at which the intermediate transfer body 15 (belt member) not bent by the first transfer roller 16 (transfer member) contacts the photoreceptor 11 (image holding member) is defined as a contact position (reference position), the first transfer roller 16 is disposed apart from the contact position (reference position) in the driving direction of the intermediate transfer belt 15 by a distance L1 as illustrated in FIG. 2. In other words, the first transfer roller 16 (transfer member) is disposed such that the straight line between the axial center of the first transfer roller 16 and the axial center of the photoreceptor 11 is not orthogonal to the driving direction of the intermediate transfer belt 15 being in an unbent state. Part of the intermediate transfer belt 15 therefore contacts part of the photoreceptor 11 along the circumference of the photoreceptor 11, and a nip N is formed between the photoreceptor 11 and the intermediate transfer belt 15.

Furthermore, a photoreceptor cleaner 17 is provided in the vicinity of the photoreceptor 11 to remove residual toner on the photoreceptor 11. The electrophotographic devices of the charger 12, laser exposure unit 13, developing unit 14, first transfer roller 16, and photoreceptor cleaner 17 are provided in sequence in the rotational direction of the photoreceptor 11. The image forming units 1Y, 1M, 1C, and 1K are disposed substantially in line in the order of yellow (Y), magenta (M), cyan (C), and black (K) from the upstream side of the intermediate transfer belt 15.

The intermediate transfer belt 15 is driven and circulates (rotates) by rollers at the intended rate in the direction denoted by the sign B in FIG. 1. Such rollers include a driving roller 31 that is driven by a motor (not illustrated) to rotate the intermediate transfer belt 15, a supporting roller 32 that supports the intermediate transfer belt 15 extending substantially in line along the direction in which the photoreceptors 11 are disposed, a tensile roller 33 that gives the intermediate transfer belt 15 tension and that functions as a correction roller that reduces meandering of the intermediate transfer belt 15, a back roller 25 provided to the second transfer part 20, and a cleaning back roller 34 provided to a cleaning part that scrapes off residual toner on the intermediate transfer belt 15.

The first transfer parts 10 each have the first transfer roller 16 as an opposite member that is disposed so as to face the photoreceptor 11 with the intermediate transfer belt 15 interposed therebetween. The first transfer roller 16 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roll having a volume resistivity ranging from $10^{7.5}$ Ωcm to $10^{8.5}$ Ωcm.

The first transfer roller 16 is disposed so as to be pressed against the photoreceptor 11 with the intermediate transfer belt 15 interposed therebetween, and a voltage (first transfer bias) is applied to the first transfer roller 16 in the polarity opposite to the polarity in which the toner has been charged (herein defined as negative polarity, the same holds true for the following description). Accordingly, toner images on the individual photoreceptors 11 are electrostatically drawn to the intermediate transfer belt 15 in sequence, and a composite toner image is formed on the intermediate transfer belt 15.

The second transfer part 20 has the back roller 25 and a second transfer roller 22 disposed so as to face the toner-image-carrying side of the intermediate transfer belt 15.

The surface of the back roller 25 is formed of a tube of blended rubber of EPDM and NBR in which carbon has been dispersed, and the inside thereof is formed of EPDM rubber. The back roller 25 is formed so as to have a surface resistivity ranging from $10^7$Ω/□ to $10^{10}$Ω/□, and the hardness thereof is adjusted to be, for instance, 700 (measured with ASKER Durometer Type C manufactured by Kobunshi Keiki Co., Ltd., the same holds true for the following description). The back roller 25 is disposed so as to face the back side of the intermediate transfer belt 15 and serves as a counter electrode of the second transfer roller 22, and a power supplying roller 26 made of metal is provided in contact with the back roller 25 to steadily apply a second transfer bias.

The second transfer roller 22 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roller having a volume resistivity ranging from $10^{7.5}$ Ωcm to $10^{8.5}$ Ωcm.

The second transfer roller 22 is disposed so as to be pressed against the back roller 25 with the intermediate transfer belt 15 interposed therebetween. The second transfer roller 22 is grounded to form a second transfer bias between the back roller 25 and the second transfer roller 22, and thus a toner image is transferred (second transfer) onto paper K that is to be transported to the second transfer part 20.

An intermediate transfer belt cleaner 35 that removes residual toner and paper dust on the intermediate transfer belt 15 after the second transfer to clean the surface thereof is provided to the intermediate transfer belt 15 downstream of the second transfer part 20 so as to be movable toward and away from the intermediate transfer belt 15.

The intermediate transfer belt 15, the first transfer parts 10 (first transfer rollers 16), and the second transfer part 20 (second transfer roller 22) correspond to an example of the transfer unit.

A reference signal sensor (home position sensor) 42 that generates a reference signal that is the basis for timing formation of images by the image forming units 1Y, 1M, 1C, and 1K is provided upstream of the image forming unit 1Y for yellow. In addition, an image density sensor 43 that adjusts image quality is provided downstream of the image forming unit 1K for black. The reference sensor 42 detects a mark provided on the back side of the intermediate transfer belt 15 and then generates a reference signal, and the controller 40 recognizes the reference signal and instructs the image forming units 1Y, 1M, 1C, and 1K to start formation of images.

The image forming apparatus of the exemplary embodiment has a transporting unit for transporting the paper K. The transporting unit includes a paper container 50 in which the paper K is accommodated, a paper feed roller 51 that takes out the paper K gathered in the paper container 50 at a predetermined timing to transport it, transport rollers 52 that transport the paper K taken out by the paper feed roller 51, a transport guide 53 that introduces the paper K transported by the transport rollers 52 to the second transfer part 20, a transport belt 55 that transports the paper K transported after the second transfer by the second transfer roller 22 to the fixing device 60, and a fixing inlet guide 56 that guides the paper K to the fixing device 60.

A basic process for forming an image in the image forming apparatus of the exemplary embodiment will now be described.

In the image forming apparatus of the exemplary embodiment, image data output from, for example, an image reader or personal computer (PC) (each not illustrated) is subjected to image processing with an image processor (not illustrated); and then the image forming units 1Y, 1M, 1C, and 1K perform an imaging operation.

The image processor performs image processing including shading compensation, misregistration correction, brightness/color space conversion, gamma correction, and a variety of image editing such as frame elimination, a color edit, and a moving edit on the basis of input data of reflectance. The image data subjected to the image processing is converted to colorant tone data of four colors of Y, M, C, and K and output to the laser exposure unit 13.

In the laser exposure unit 13, an exposure beam Bm emitted from, for example, a semiconductor laser is radiated to the photoreceptor 11 of each of the image forming units 1Y, 1M, 1C, and 1K on the basis of the input colorant tone data. The surfaces of the photoreceptors 11 of the image forming units 1Y, 1M, 1C, and 1K are charged with the charger 12; and the charged surfaces are subjected to scanning exposure with the laser exposure unit 13 to form electrostatic charge images. The formed electrostatic charge images are developed by the image forming units 1Y, 1M, 1C, and 1K into toner images of Y, M, C, and K, respectively.

The toner images formed on the photoreceptors 11 of the image forming units 1Y, 1M, 1C, and 1K are transferred to the intermediate transfer belt 15 at the nips N formed in the first transfer parts 10 in which the individual photoreceptors 11 are in contact with the intermediate transfer belt 15. More specifically, the first transfer is carried out in the first transfer parts 10 as follows: the first transfer rollers 16 apply voltage (first transfer bias) to the substrate of the intermediate transfer belt 15 in the polarity opposite to the polarity in which toner has been charged (negative polarity), and the toner images are placed one upon another on the surface of the intermediate transfer belt 15 in sequence.

After the toner images are sequentially subjected to the first transfer to the surface of the intermediate transfer belt 15, the intermediate transfer belt 15 moves to transport the toner images to the second transfer part 20. The transportation of the toner images to the second transfer part 20 causes the paper feed roller 51 in the transporting unit to rotate on the basis of the timing of the transportation of the toner images to the second transfer part 20, and paper K with the intended size is supplied from the paper container 50. The paper K supplied by the paper feed roller 51 is transported by the transport rollers 52 and then reaches the second transfer part 20 through the transport guide 53. Before the paper K reaches the second transfer part 20, the paper K is stopped, an alignment roller (not illustrated) rotates on the basis of the timing of the movement of the intermediate transfer belt 15 carrying the toner images to align the position of the paper K with the position of the toner images.

In the second transfer part 20, the second transfer roller 22 is pressed against the back roller 25 with the intermediate transfer belt 15 interposed therebetween. The paper K transported at the right timing enters between the intermediate transfer belt 15 and the second transfer roller 22. At this time, the power supplying roller 26 applies voltage (second transfer bias) in the polarity the same as the polarity in which toner has been charged (negative polarity), and then a transfer electric field is formed between the second transfer roller 22 and the back roller 25. The unfixed toner images carried by the intermediate transfer belt 15 are electrostatically transferred onto the paper K at one time at the second transfer part 20 at which the second transfer roller 22 and the back roller 25 are pressed against each other.

Then, the paper K having the electrostatically transferred toner images is transported by the second transfer roller 22 in a state in which it is separated from the intermediate transfer belt 15 and reaches the transport belt 55 provided downstream of the second transfer roller 22 in the direction in which the paper is transported. The transport belt 55 transports the paper K to the fixing device 60 at the optimum transport rate for the fixing device 60. The unfixed toner images on the paper K transported to the fixing device 60 are fixed onto the paper K with heat and pressure in the fixing device 60. The paper K having the fixed image is transported to an ejected paper holder (not illustrated) provided to an ejection part of the image forming apparatus.

After the transfer to the paper K is finished, residual toner on the intermediate transfer belt 15 is transported to the cleaning part by the rotation of the intermediate transfer belt 15 and then removed from the intermediate transfer belt 15 with the cleaning back roller 34 and the intermediate transfer belt cleaner 35.

An example of the exemplary embodiment has been described; however, the exemplary embodiment is not limited thereto and can be variously modified, changed, and reformed.

Other Examples of Numbers and Arrangement of First Transfer Roller (Transfer Member)

In the first example of the image forming apparatus, a single first transfer roller 16 (transfer member) is provided so as to face one photoreceptor 11 (image holding member) with the intermediate transfer belt 15 (belt member) interposed therebetween as illustrated in FIGS. 1 and 2. In the exemplary embodiment, however, the transfer member may be provided to one image holding member in a different manner. Multiple transfer members, for instance, may be provided so as to face one image holding member with the belt member interposed therebetween.

Figure 3:
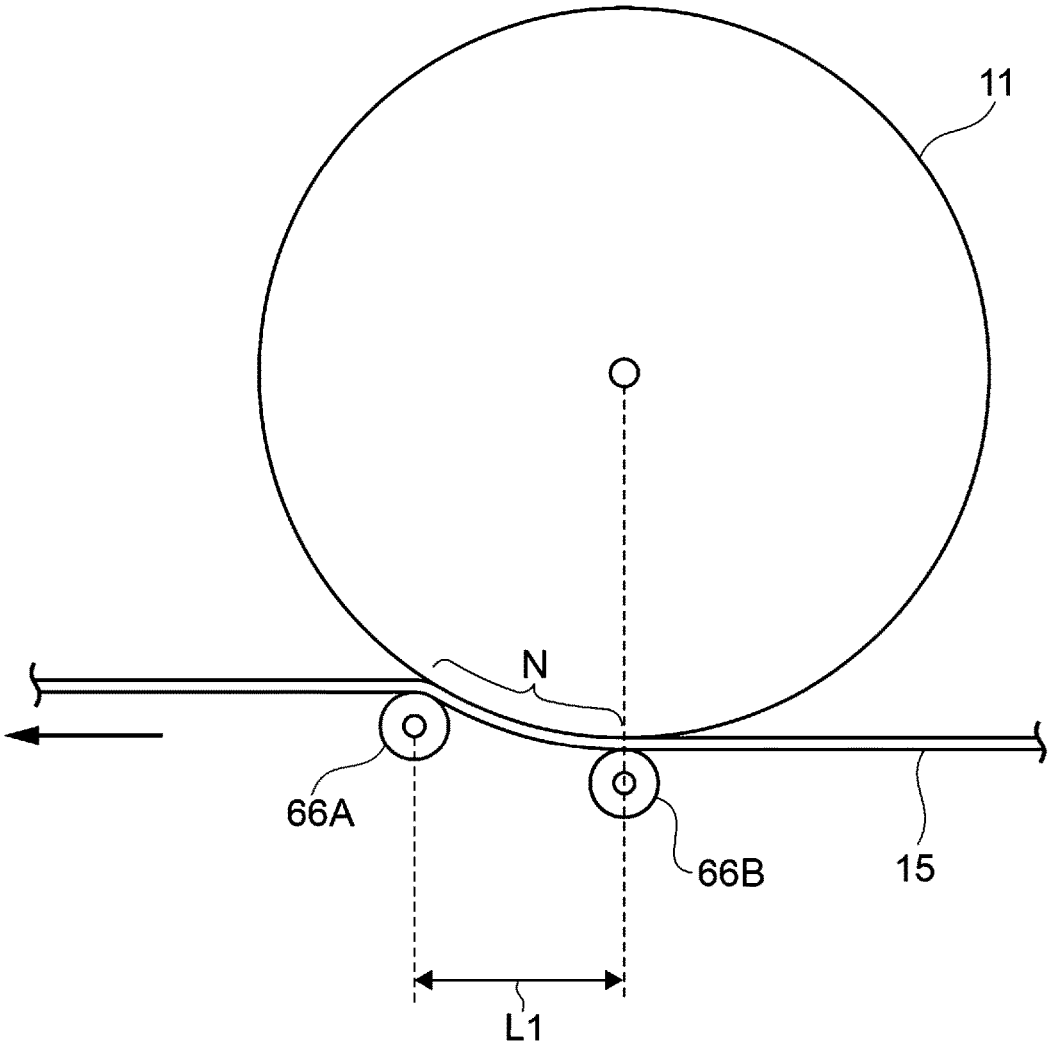
FIG. 3 schematically illustrates another example of the positional relationship between the image holding member and the transfer member in the image forming apparatus according to the exemplary embodiment.

Two first transfer rollers 66A and 66B (transfer members) may be, for example, provided so as to face one photoreceptor 11 (image holding member) with the intermediate transfer belt 15 (belt member) interposed therebetween as illustrated in FIG. 3. In FIG. 3, the first transfer roller 66A is disposed apart from the reference position (position at which the photoreceptor 11 contacts the intermediate transfer belt 15 being in an unbent state) in the driving direction of the intermediate transfer belt 15 by the distance L1 (namely, disposed at an offset position), and the first transfer roller 66B is disposed at the reference position. Part of the intermediate transfer belt 15 therefore contacts part of the photoreceptor 11 along the circumference of the photoreceptor 11 to form the nip N between the photoreceptor 11 and the intermediate transfer belt 15.

Since the intermediate transfer belt 15 (belt member) is pressed against the photoreceptor 11 (image holding member) by the first transfer rollers 66A and 66B (transfer members), nip pressure [pressure that the photoreceptor 11 (image holding member) and the intermediate transfer belt 15 (belt member) apply to a toner image passing through the nip] can be easily enhanced, so that the efficiency of the transfer of the toner image can be further readily improved.

Figure 4:
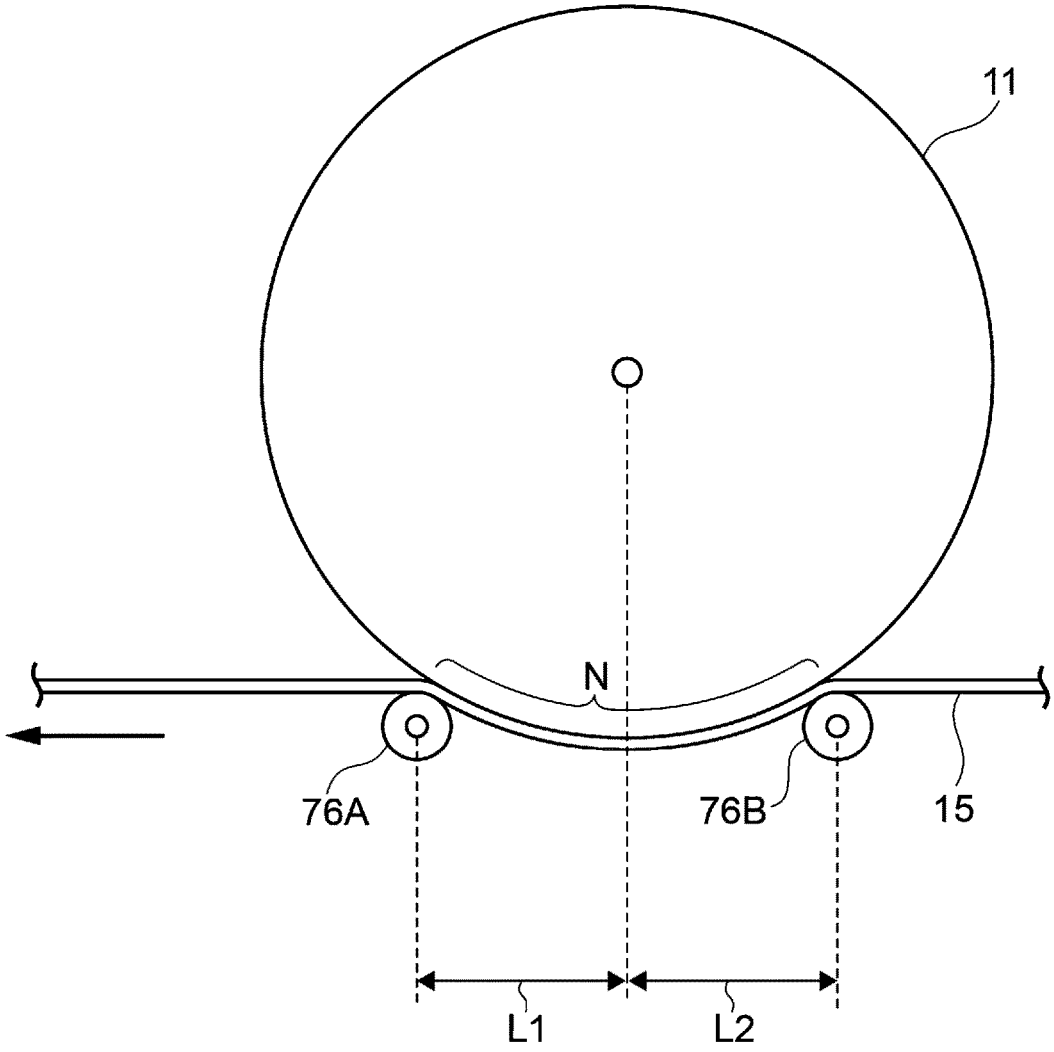
FIG. 4 schematically illustrates another example of the positional relationship between the image holding member and the transfer member in the image forming apparatus according to the exemplary embodiment.

As illustrated in FIG. 4, two first transfer rollers 76A and 76B (transfer members) may be provided so as to face one photoreceptor 11 (image holding member) with the intermediate transfer belt 15 (belt member) interposed therebetween, and each of the first transfer rollers 76A and 76B may be disposed apart from the reference position. In FIG. 4, the first transfer roller 76A is disposed downstream of the reference position (position at which the photoreceptor 11 contacts the intermediate transfer belt 15 being in an unbent state) in the driving direction of the intermediate transfer belt 15 by the distance L1 (namely, disposed at an offset position), and the first transfer roller 76B is disposed upstream of the reference position by a distance L2 in the driving direction of the intermediate transfer belt 15 (namely, disposed at an offset position). Part of the intermediate transfer belt 15 therefore contacts part of the photoreceptor 11 along the circumference of the photoreceptor 11 to form the nip N between the photoreceptor 11 and the intermediate transfer belt 15.

Since the first transfer rollers 76A and 76B (transfer members) are disposed downstream and upstream of the reference position in the driving direction of the intermediate transfer belt 15 (belt member), respectively, the nip N has a larger width; thus, the efficiency of the transfer of a toner image can be further readily improved.

Figure 5:
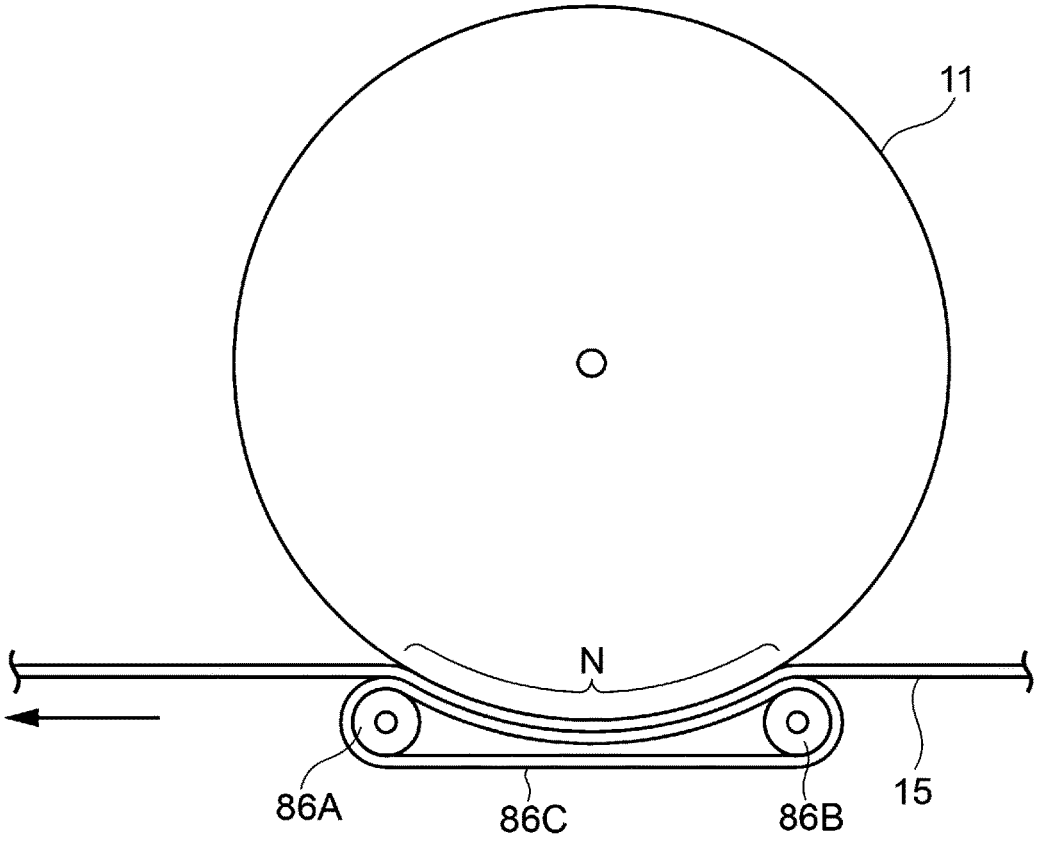
FIG. 5 schematically illustrates another example of the positional relationship between the image holding member and the transfer member in the image forming apparatus according to the exemplary embodiment.

Furthermore, as illustrated in FIG. 5, two first transfer rollers 86 A and 86B (transfer members) may be provided so as to face one photoreceptor 11 (image holding member) with the intermediate transfer belt 15 (belt member) interposed therebetween, and a pressure belt 86C may be put around the transfer rollers 86A and 86B to apply pressure to the intermediate transfer belt 15 toward the photoreceptor 11. In FIG. 5, the first transfer roller 86A is disposed downstream of the reference position (position at which the photoreceptor 11 contacts the intermediate transfer belt 15 being in an unbent state) in the driving direction of the intermediate transfer belt 15 by the distance L1 (namely, disposed at an offset position), and the first transfer roller 86B is disposed upstream of the reference position in the driving direction of the intermediate transfer belt 15 by the distance L2 (namely, disposed at an offset position). The pressure belt 86C is put around the first transfer rollers 86A and 86B, and the first transfer rollers 86A and 86B face the intermediate transfer belt 15 with the pressure belt 86C interposed therebetween. The pressure belt 86C enables application of pressure to the intermediate transfer belt 15 also in the region between the first transfer rollers 86A and 86B; hence, nip pressure [pressure that the photoreceptor 11 (image holding member) and the intermediate transfer belt 15 (belt member) apply to a toner image passing through the nip] can be easily enhanced, so that the efficiency of the transfer of the toner image can be further readily improved.

In order to give the nip a wider width with a simple structure, a single transfer member is suitably provided to one image holding member and disposed apart from the reference position in the driving direction of the belt member (namely, disposed at an offset position) so as to face the image holding member with the belt member interposed therebetween. Such a single transfer member is further suitably disposed downstream of the reference position in the driving direction of the belt member (namely, disposed at an offset position such as in FIGS. 1 and 2).

In order to give the nip a further wider width, it is suitable that multiple transfer members be provided to one image holding member so as to face the image holding member with the belt member interposed therebetween and that one or more of the transfer members be disposed apart from the reference position in the driving direction of the belt member (namely, disposed at an offset position such as in FIGS. 3, 4, and 5). It is more suitable that one of the multiple transfer members be disposed downstream of the reference position in the driving direction of the belt member (namely, disposed at an offset position) and that another one of them be disposed upstream of the reference position in the driving direction of the belt member (namely, disposed at an offset position such as in FIGS. 4 and 5).

Voltage (Transfer Bias) Applied by First Transfer Roller (Transfer Member)

In the case where multiple transfer members are provided to one image holding member, voltage (transfer bias) may be applied by at least one of the multiple transfer members in the polarity opposite to the polarity in which the toner has been charged or may be applied by all of them. The transfer bias is suitably applied by at least the transfer member disposed most upstream in the driving direction of the belt member.

In FIG. 3, for example, the transfer bias may be applied by only any one of the first transfer rollers 66A and 66B or by both of them. The transfer bias is suitably applied by at least the first transfer roller 66B disposed upstream in the driving direction of the belt member.

In FIG. 4, the transfer bias may be applied by only any one of the first transfer rollers 76A and 76B or by both of them. The transfer bias is suitably applied by at least the first transfer roller 76B disposed on the upstream side.

In FIG. 5, the transfer bias may be applied by only any one of the first transfer rollers 86A and 86B or by both of them. The transfer bias is suitably applied by at least the first transfer roller 86B disposed on the upstream side.

The voltage (transfer bias) applied by the transfer member may be an alternating-current voltage, a direct-current voltage, or a voltage in which a direct-current voltage has been superimposed on an alternating-current voltage (superimposed voltage); and a superimposed voltage is suitably applied. In particular, in the exemplary embodiment, the transfer bias that is a superimposed voltage in which a direct-current voltage has been superimposed on an alternating-current voltage is suitably applied by at least one transfer member.

Application of the transfer bias as a superimposed voltage by the transfer member causes electric charges in a toner image to reciprocate owing to an electrostatic interaction, and the adhesion of the toner image is therefore reduced. As a result, the efficiency of the transfer of the toner image can be easily enhanced.

In the case where multiple transfer members are provided to one image holding member and where a transfer bias is applied by at least two of the transfer members, a superimposed voltage may be applied by all of them; alternatively, a superimposed voltage may be applied by at least one (for example, one) of the transfer members, and an alternating-current voltage or a direct-current voltage may be applied by the rest of the transfer members. In view of the type of voltage (transfer bias) to be applied by the transfer members, it is suitable that a direct-current voltage be applied by the transfer member disposed most downstream in the driving direction of the belt member and that a superimposed voltage be applied by the rest of the transfer members upstream thereof.

In FIG. 3, for example, in the case where a transfer bias is applied by all of the transfer members (first transfer rollers 66A and 66B) and where a transfer bias as a superimposed voltage is applied by at least one of the transfer members, a superimposed voltage may be applied by both of the first transfer rollers 66A and 66B; alternatively, a superimposed voltage may be applied by any one of these transfer members, and an alternating-current voltage or a direct-current voltage may be applied by the other one of the transfer members. It is suitable that a direct-current voltage be applied by the first transfer roller 66A disposed most downstream in the driving direction of the belt member and that a superimposed voltage be applied by the first transfer roller 66B disposed upstream thereof.

In FIG. 4, in the case where a transfer bias is applied by all of the transfer members (first transfer rollers 76A and 76B) and where a transfer bias as a superimposed voltage is applied by at least one of the transfer members, a superimposed voltage may be applied by both of the first transfer rollers 76A and 76B; alternatively, a superimposed voltage may be applied by any one of these transfer members, and an alternating-current voltage or a direct-current voltage may be applied by the other one of the transfer members. It is suitable that a direct-current voltage be applied by the first transfer roller 76A disposed most downstream in the driving direction of the belt member and that a superimposed voltage be applied by the first transfer roller 76B disposed upstream thereof.

In FIG. 5, in the case where a transfer bias is applied by all of the transfer members (first transfer rollers 86A and 86B) and where a transfer bias as a superimposed voltage is applied by at least one of the transfer members, a superimposed voltage may be applied by both of the first transfer rollers 86A and 86B; alternatively, a superimposed voltage may be applied by any one of these transfer members, and an alternating-current voltage or a direct-current voltage may be applied by the other one of the transfer members. It is suitable that a direct-current voltage be applied by the first transfer roller 86A disposed most downstream in the driving direction of the belt member and that a superimposed voltage be applied by the first transfer roller 86B disposed upstream thereof.

Voltage (Transfer Bias) Applied by Second Transfer Roller

Any of an alternating-current voltage, a direct-current voltage, and a voltage in which a direct-current voltage has been superimposed on an alternating-current voltage (superimposed voltage) may be applied by the power supplying roller 26 to form a transfer electric field (second transfer bias) between the second transfer roller 22 and the back roller 25. In particular, application of a direct-current voltage or superimposed voltage is preferred, and application of a superimposed voltage is more preferred.

Structure of Image Forming Apparatus (Second Example)

An example of the image forming apparatus in which the belt member is used as the recording medium transporting belt (paper transporting belt) in the transfer unit will now be described.

Figure 6:
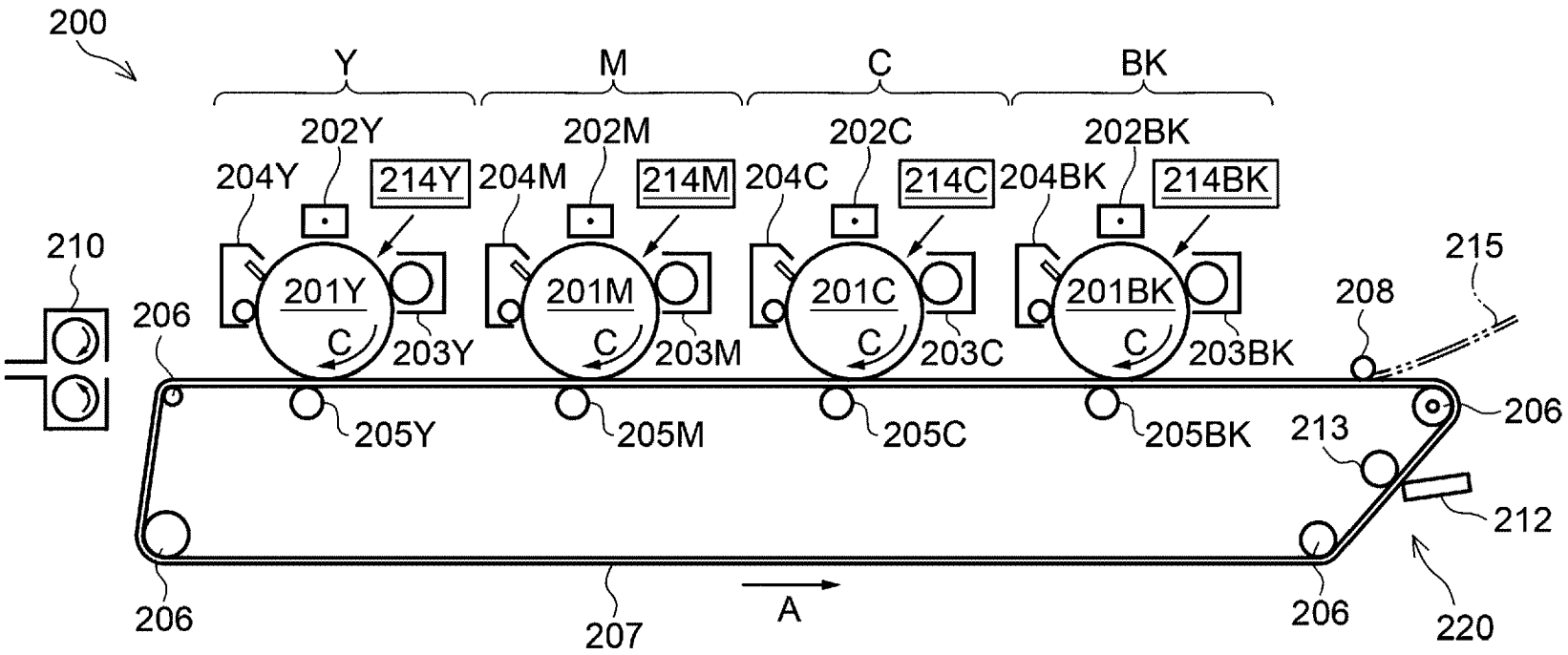
FIG. 6 schematically illustrates another example of the structure of the image forming apparatus according to the exemplary embodiment.

FIG. 6 schematically illustrates another example of the structure of the image forming apparatus according to the exemplary embodiment.

In an image forming apparatus 200 illustrated in FIG. 6, units Y, M, C, and BK have photoreceptor drums 201Y, 201M, 201C, and 201 BK (example of image holding member) that rotate clockwise as indicated by the arrow C, respectively. In the vicinity of the photoreceptor drums 201Y, 201M, 201C, and 201 BK, chargers 202Y, 202M, 202C, and 202BK (example of charging unit); exposure units 214Y, 214M, 214C, and 214BK (example of electrostatic charge image forming unit); developing devices for individual colors (yellow developing device 203Y, magenta developing device 203M, cyan developing device 203C, and black developing device 203BK) (example developing unit); and photoreceptor drum cleaning members 204Y, 204M, 204C, and 204BK are provided, respectively.

At least one of the developing devices for individual colors has the above-mentioned specific toner. In the exemplary embodiment, all of the developing devices for individual colors suitably have the specific toner.

The four units Y, M, C, and BK are disposed in parallel with a paper transporting belt 207 (example of belt member) in the order of the units BK, C, M, and Y. The four units may be, however, disposed in another order such as the units BK, Y, C, and M; and the order of the arrangement of the units is appropriately determined on the basis of an image forming process.

The paper transporting belt 207 is supported by four belt supporting rollers 206 disposed inside the paper transporting belt 207. The paper transporting belt 207 rotates counterclockwise as indicated by the arrow A at the same rotational speed as the photoreceptor drums 201Y, 201M, 201C, and 201BK; and part of the paper transporting belt 207 between the belt supporting rollers 206 contacts each of the photoreceptor drums 201Y, 201M, 201C, and 201BK.

Transfer rollers 205Y, 205M, 205C, and 205BK (example of transfer member) are disposed inside the paper transporting belt 207 so as to face the position at which the photoreceptor drums 201Y, 201M, 201C, and 201BK contact the paper transporting belt 207, respectively. The transfer rollers 205Y, 205M, 205C, and 205BK and the photoreceptor drums 201Y, 201M, 201C, and 201BK form a transfer region with the paper transporting belt 207 interposed therebetween; in the transfer region, a toner image is transferred onto paper 215 (example of recording medium).

Also in the image forming apparatus 200, the transfer rollers 205 are disposed out of alignment (offset) in the driving direction of the paper transporting belt 207 as illustrated in FIG. 2. In particular, when the position at which the paper transporting belt 207 (belt member) not bent by the transfer roller 205 (transfer member) contacts the photoreceptor drum 201 (image holding member) is defined as a contact position (reference position), the transfer roller 205 is disposed apart from the contact position (reference position) in the driving direction of the paper transporting belt 207 by the distance L1. In other words, the transfer roller 205 (transfer member) is disposed such that the straight line between the axial center of the transfer roller 205 and the axial center of the photoreceptor drum 201 is not orthogonal to the driving direction of the paper transporting belt 207 being in an unbent state. Part of the paper transporting belt 207 therefore contacts part of the photoreceptor drum 201 along the circumference of the photoreceptor drum 201, and the nip N is formed between the photoreceptor drum 201 and the paper transporting belt 207.

In the second example, the transfer roller 205 (transfer member) may be provided to one photoreceptor drum 201 (image holding member) in a different manner; for example, multiple transfer rollers 205 may be provided so as to face one photoreceptor drum 201 with the paper transporting belt 207 (belt member) interposed therebetween.

The following structures described in the first example may be, for instance, employed: the structure illustrated in FIG. 3 (two transfer members are provided so as to face one image holding member with the belt member interposed therebetween, one of the transfer members is disposed at the reference position, and the other one is disposed apart from the reference position); the structure illustrated in FIG. 4 (two transfer members are provided so as to face one image holding member with the belt member interposed therebetween, and each of the transfer members is disposed apart from the reference position); and the structure illustrated in FIG. 5 (two transfer members are provided so as to face one image holding member with the belt member interposed therebetween, and a pressure belt is put around the two transfer members to apply pressure to the belt member toward the image holding member).

In order to give the nip a wider width with a simple structure, a single transfer member is suitably provided to one image holding member and disposed apart from the reference position in the driving direction of the belt member (namely, disposed at an offset position) so as to face the image holding member with the belt member interposed therebetween. Such a single transfer member is further suitably disposed downstream of the reference position in the driving direction of the belt member (namely, disposed at an offset position such as in FIG. 2).

In the case where multiple transfer members are provided to one image holding member, voltage (transfer bias) may be applied by at least one of the multiple transfer members in the polarity opposite to the polarity in which the toner has been charged or may be applied by all of them. The transfer bias is suitably applied by at least the transfer member disposed most upstream in the driving direction of the belt member.

The voltage (transfer bias) applied by the transfer member may be an alternating-current voltage, a direct-current voltage, or a voltage in which a direct-current voltage has been superimposed on an alternating-current voltage (superimposed voltage); and superimposed voltage is suitably applied. In particular, the transfer bias that is a superimposed voltage in which a direct-current voltage has been superimposed on an alternating-current voltage is suitably applied by at least one transfer member.

In the case where multiple transfer members are provided to one image holding member and where a transfer bias is applied by at least two of the transfer members, a superimposed voltage may be applied by all of them; alternatively, a superimposed voltage may be applied by at least one (for example, one) of the transfer members, and an alternating-current voltage or a direct-current voltage may be applied by the rest of the transfer members. In view of the type of voltage (transfer bias) to be applied by the transfer members, it is suitable that a direct-current voltage be applied by the transfer member disposed most downstream in the driving direction of the belt member and that a superimposed voltage be applied by the rest of the transfer members upstream thereof.

A cleaning blade 212 is disposed so as to contact the paper transporting side (outer surface) of the paper transporting belt 207. A cleaning counter roller 213 is provided as a conductive counter member in contact with the paper transporting belt 207 so as to face the cleaning blade 212 with the paper transporting belt 207 interposed therebetween. The cleaning blade 212 and the cleaning counter roller 213 serve as a paper transporting belt cleaning device 220.

The paper transporting belt cleaning device 220 may perform cleaning with a brush, a roller, or a scraper in addition to the cleaning blade 212.

A fixing device 210 (example of fixing unit) is positioned so that paper that has passed through the individual transfer regions formed by the paper transporting belt 207 and the photoreceptor drums 201Y, 201M, 201C, and 201BK is transported thereto.

The paper 215 is fed to the paper transporting belt 207 by a paper feeding roller 208.

In the unit BK of the image forming apparatus illustrated in FIG. 6, the photoreceptor drum 201BK is rotationally driven. The charger 202BK is driven in conjunction with the rotational driving of the photoreceptor drum 201BK to charge the surface of the photoreceptor drum 201BK in the intended polarity and electric potential. The photoreceptor drum 201BK having the charged surface is exposed to light by the exposure unit 214BK in the shape of an image, thereby forming an electrostatic charge image on the surface thereof.

The electrostatic charge image is developed by the black developing device 203BK to form a toner image on the surface of the photoreceptor drum 201BK. The developer to be used may be a single component developer or a two-component developer.

The toner image passes through the nip N in the transfer region formed by the photoreceptor drum 201BK and the paper transporting belt 207. The paper 215 electrostatically adhering to the paper transporting belt 207 is transported to the transfer region, and the toner image is transferred to the surface of the paper 215 owing to an electric field formed by a transfer bias applied by the transfer roller 205BK.

The toner remaining on the photoreceptor drum 201BK is removed by the photoreceptor drum cleaning member 204BK. The photoreceptor drum 201BK in this state serves for the next transfer of an image.

This process for transferring an image is similarly carried out in the units C, M, and Y.

The paper 215 having toner images transferred by the transfer rollers 205BK, 205C, 205M, and 205Y is transported to the fixing device 210; and the toner images are fixed.

The photoreceptor drum cleaning members 204Y, 204M, 204C, and 204BK remove toner remaining on the photoreceptor drums 201Y, 201M, 201C, and 201BK after the transfer, respectively. The cleaning blade 212 of the paper transporting belt cleaning device 220 removes toner remaining on the paper transporting belt 207 after the recording medium 215 is transported. Then, the paper transporting belt 207 is ready for the next formation of an image.

An image is formed on paper in this manner.

The belt member used in the transfer unit will now be described.

Belt Member Used in Transfer Unit

The belt member, for instance, suitably contains a resin material. The belt member may contain a conductive agent to be conductive; in addition, it may further contain other known additives.

Examples of the resin material used in the belt member include polyimide resins, fluorinated polyimide resins, polyamide resins, polyamide-imide resins, polyether-ether-ester resins, polyarylate resins, and polyester resins.

These resin materials may be used alone or in combination in the belt member.

Among these resin materials, at least either one of polyimide resins and polyamide-imide resins are suitably used in order to enhance the rigidity of the inner surface of the belt member and to thus make the belt member less likely to be deformed when it is put around the multiple rollers under tension.

The belt member may contain a conductive agent to be conductive.

Examples of the conductive agent include conductive (for example, having a volume resistivity of less than $10^7$ Ω·cm, the same holds true for the following description) or semi-conductive (for example, having a volume resistivity ranging from $10^7$ Ω·cm to $10^{13}$ Ω·cm, the same holds true for the following description) particles.

The conductive agent is suitably particles having a primary particle size of less than 10 μm, and further suitably particles having a primary particle size of 1 μm or less.

Examples of the conductive agent include, but are not limited to, carbon blacks (such as KETJENBLACK, acetylene black, and carbon black having an oxidized surface); materials involving carbon, such as carbon fibers, carbon nanotubes, and graphite; metals and alloys (such as aluminum, nickel, copper, and silver); metal oxides (such as yttrium oxide, tin oxide, indium oxide, antimony oxide, and $SnO_2$—$In_2O_3$ composite oxide); and ionic conductive materials (such as potassium titanate and LiCl).

The conductive agent is selected on the basis of the intended use. The conductive agent is suitably a carbon black; in terms of temporal stability of electric resistance and electric field dependence that reduces electric field concentration caused by transfer voltage, oxidized carbon black having pH of 5 or less (preferably pH of 4.5 or less, and more preferably pH of 4.0 or less) is suitably used (for example, carbon black produced by introducing a carboxyl group, a quinone group, a lactone group, or a hydroxyl group to the surface thereof).

The conductive agent content in the belt member is determined on the basis of the intended resistance; for example, it is preferably from 1 mass % to 50 mass %, more preferably from 2 mass % to 40 mass %, and further preferably from 4 mass % to 30 mass % relative to the mass of the whole belt member.

The conductive agents may be used alone or in combination.

Examples of additives other than the conductive agent include dispersants for enhancing the dispersibility of the conductive agent (carbon black or another material); a variety of fillers to give various properties, such as mechanical strength; catalysts; leveling agents for enhancing the quality of films to be formed; and releasing materials for improving releasing properties [such as particles of fluororesin, e.g., polytetrafluoroethylene (PTFE), a tetrafluoroethylene-perfluoroalkyl vinyl ether copolymer (PFA), and a tetrafluoroethylene-hexafluoropropylene copolymer (FEP)].

Properties of Belt Member

The common logarithm value of the surface resistivity of the outer surface of the belt member used in the transfer unit is preferably from 9 (Log Ω/□) to 13 (Log Ω/□), and more preferably from 10 (Log Ω/□) to 12 (Log Ω/□) in view of transferability.

The common logarithm value of the surface resistivity is controlled on the basis of the type and amount of a conductive agent to be used.

Figure 7A:
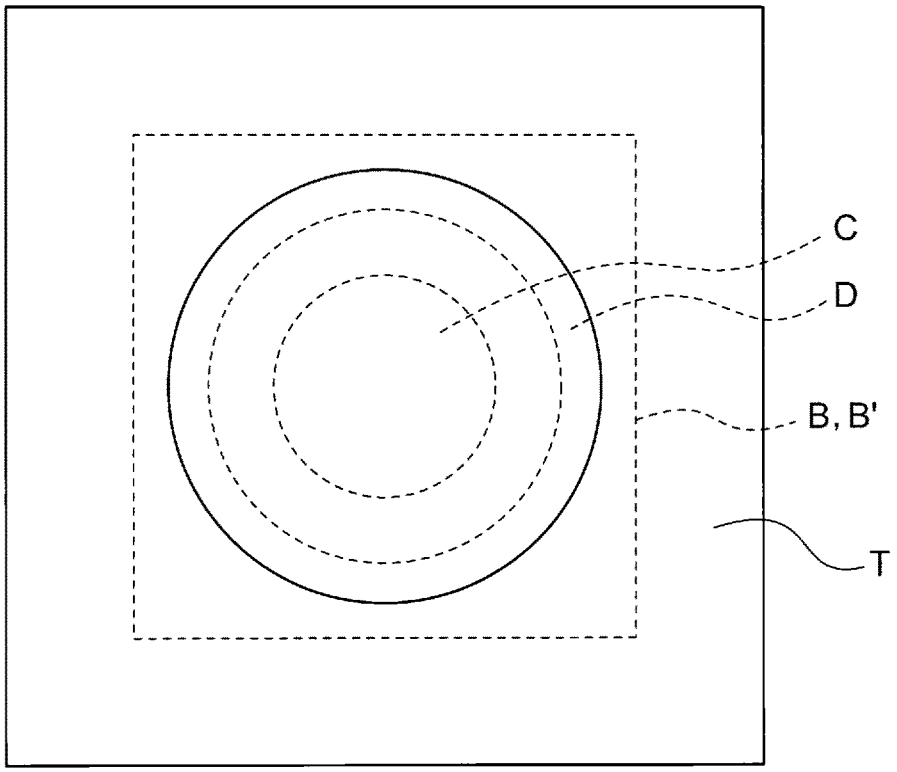
FIG. 7A is a schematic plan view illustrating an example of a circular electrode.
Figure 7B:
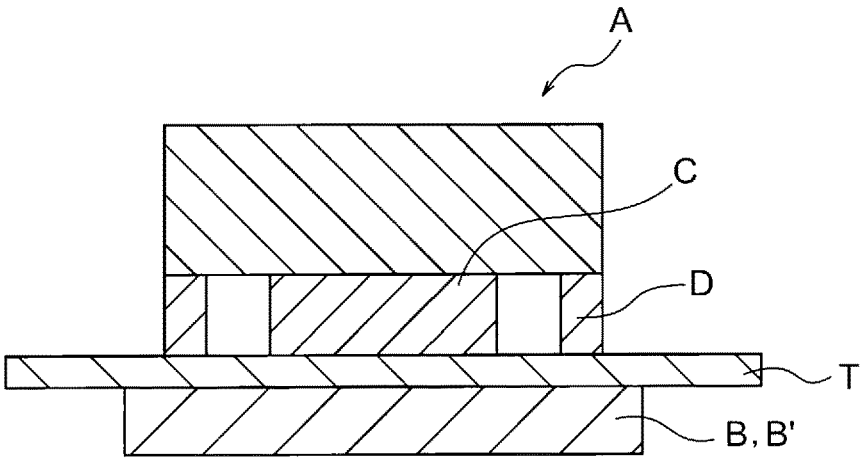
FIG. 7B is a schematic cross-sectional view illustrating the circular electrode illustrated in FIG. 7A.

The surface resistivity is measured as follows. The surface resistivity is measured with a circular electrode (for example, "UR probe" of HIRESTA IP manufactured by Mitsubishi Petrochemical Co., Ltd.) in accordance with JIS-K6911 (in 1995). The measurement of the surface resistivity is described with reference to the drawings. FIG. 7A is a schematic plan view illustrating an example of the circular electrode, and FIG. 7B is a schematic cross-sectional view illustrating the circular electrode illustrated in FIG. 7A. The circular electrode illustrated in FIGS. 7A and 7B includes a first voltage applying electrode A and a planar insulator B. The first voltage applying electrode A includes a columnar electrode part C and a cylindrical ring electrode part D having an inner diameter larger than the outer diameter of the columnar electrode part C and surrounding the columnar electrode part C so as to be spaced at regular intervals. A belt T is disposed between the first voltage applying electrode A, which includes the columnar electrode part C and the ring electrode part D, and the planar insulator B. A voltage V (V) is applied between the columnar electrode part C and ring electrode part D of the first voltage applying electrode A, and an electric current I (A) flowing at this time is measured. Then, the surface resistivity ρs (Ω/□) of the transfer side of the belt T is calculated from the below equation. In the equation, d (mm) refers to the outer diameter of the columnar electrode part C, and D (mm) refers to the inner diameter of the ring electrode part D.

$$\rho s=\pi\times(D+d)/(D-d)\times(V/I) \quad \text{Equation:}$$

In order to calculate the surface resistivity, a voltage of 500 V is applied for 10 seconds with a circular electrode ("UR probe" of HIRESTA IP manufactured by Mitsubishi Petrochemical Co., Ltd., outer diameter of columnar electrode part C: 16 mm, inner diameter of ring electrode part D: 30 mm, and outer diameter of ring electrode part D: 40 mm) at a temperature of 22 C° and 55% RH, and then the electric current is measured.

In the case where the belt member is, for example, used as the intermediate transfer belt or the recording medium transporting belt in the image forming apparatus, the common logarithm value of the volume resistivity of the entire belt member is suitably from 8 (Log Ω/cm) to 13 (Log Ω/cm) in view of transferability. The common logarithm value of the volume resistivity is controlled on the basis of the type and amount of a conductive agent to be used.

The volume resistivity is measured with a circular electrode (for example, "UR probe" of HIRESTA IP manufactured by Mitsubishi Petrochemical Co., Ltd.) in accordance with JIS-K6911 (in 1995). The measurement of the volume resistivity is described with reference to FIGS. 7A and 7B. The same device used for the measurement of the surface resistivity is used for the measurement of the volume resistivity. In the circular electrode illustrated in FIGS. 7A and 7B, a second voltage applying electrode B' replaces the planar insulator B used for the measurement of the surface resistivity. A belt T is disposed between the first voltage applying electrode A, which includes the columnar electrode part C and the ring electrode part D, and the second voltage applying electrode B'. A voltage V (V) is applied between the columnar electrode part C of the first voltage applying electrode A and the second voltage applying electrode B', and an electric current I (A) flowing at this time is measured. Then, the volume resistivity ρv (Ω/cm) of the belt T is calculated from the below equation. In the equation, t refers to the thickness of the belt T.

$$\rho v=19.6\times(V/I)\times t \quad \text{Equation:}$$

In order to calculate the volume resistivity, a voltage of 500 V is applied for 10 seconds with a circular electrode ("UR probe" of HIRESTA IP manufactured by Mitsubishi Petrochemical Co., Ltd., outer diameter of columnar electrode part C: 16 mm, inner diameter of ring electrode part D: 30 mm, and outer diameter of ring electrode part D: 40 mm) at a temperature of 22 C° and 55% RH, and then the electric current is measured.

The value 19.6 in the above equation is a coefficient of the electrode for conversion into resistivity and determined from $\pi d^2/4$ t in which d (mm) is the outer diameter of the columnar electrode part and t is the thickness (cm) of a sample. The thickness of the belt T is measured with an EDDY CURRENT COATING THICKNESS METER CTR-1500E manufactured by SANKO ELECTRONIC LABORATORY CO., LTD.

The thickness (average thickness) of the belt member is preferably from 0.05 mm to 0.5 mm, more preferably from 0.06 mm to 0.30 mm, and further preferably from 0.06 mm to 0.15 mm.

Electrostatic Charge Image Developer

An electrostatic charge image developer contained in the developing unit of the image forming apparatus of the exemplary embodiment (also referred to as "electrostatic charge image developer used in the exemplary embodiment") will now be described in detail.

The electrostatic charge image developer used in the exemplary embodiment at least contains toner.

The electrostatic charge image developer used in the exemplary embodiment may be a single component developer containing only toner or may be a two-component toner containing toner and a carrier.

Toner

The toner contains toner particles. The toner may contain an external additive in addition to the toner particles.

Toner Particles

The toner particles contain, for example, a binder resin. The toner particles may contain a colorant, a release agent, and another additive.

Binder Resin

The binder resin to be used is an amorphous polyester resin.

The amorphous resin herein does not show a clear endothermic peak but show only a step-like endothermic change in a thermal analysis by differential scanning calorimetry (DSC); in addition, it is a solid at normal temperature and thermoplasticized at the glass transition temperature or higher.

In contrast, a crystalline resin does not show a step-like change in the amount of endothermic energy but show a clear endothermic peak in an analysis by differential scanning calorimetry (DSC).

Specifically, for example, the half-value width of the endothermic peak of the crystalline resin is within 10° C. when the analysis is performed at a temperature increase rate of 10° C./min, and the amorphous resin has a half-value width of greater than 10° C. or does not have a clear endothermic peak.

Examples of the amorphous polyester resin include polycondensates of a polycarboxylic acid with a polyhydric alcohol. The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

Alkylene oxide adducts of bisphenol A (such as ethylene oxide adduct of bisphenol A, propylene oxide adduct of bisphenol A, and ethylene oxide-propylene oxide adduct of bisphenol A) are not used as the polyhydric alcohol or used in a slight amount if any. Specifically, in the case where an alkylene oxide adduct of bisphenol A is used, the amount thereof is greater than 0 mol % but not more than 5 mol % relative to the amount of the whole polyhydric alcohol.

The amorphous polyester resin has a glass transition temperature (Tg) ranging preferably from 50° C. to 80° C., and more preferably from 50° C. to 65° C.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The amorphous polyester resin has a weight average molecular weight (Mw) ranging preferably from 5000 to 1000000, more preferably from 7000 to 500000, and further preferably from 30000 to 50000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and the number average molecular weight are determined by gel permeation chromatography (GPC). The determination of the molecular weight by GPC involves using a measurement apparatus that is GPC•HLC-8120GPC manufactured by Tosoh Corporation, a column that is TSK gel Super HM-M (15 cm) manufactured by Tosoh Corporation, and a tetrahydrofuran (THF) solvent. From results of GPC, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used, such monomers are preliminarily subjected to condensation with an acid or alcohol that is to undergo polycondensation with the monomers, and then the resulting product is subjected to polycondensation with the principle components.

The amount of the amorphous polyester resin is preferably from 60 mass % to 98 mass %, more preferably from 70 mass % to 98 mass %, and further preferably 80 mass % to 98 mass % relative to the amount of the whole binder resin.

The amorphous polyester resin may be used in combination with a crystalline resin. The combined use of a crystalline resin enables the moisture absorption of the toner particles to be lowered and thus easily leads to an enhancement in the transferability of a toner image. The amount of a crystalline polyester resin to be used may be in the range of 2 mass % to 40 mass % (suitably 2 mass % to 20 mass %) relative to the amount of the whole binder resin.

Examples of the crystalline resin include known crystalline resins such as crystalline polyester resins and crystalline vinyl resins (such as polyalkylene resin and long-chain alkyl(meth)acrylate resin). Among these, crystalline polyester resins are suitable in terms of an enhancement in the transferability of a toner image.

Examples of the crystalline polyester resin include polycondensates of a polycarboxylic acid with a polyhydric alcohol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mol % or more, and suitably 90 mol % or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak Temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in production of the amorphous polyester resin.

The amount of the crystalline resin (suitably crystalline polyester resin) is preferably from 3 mass % to 20 mass %, and more preferably from 5 mass % to 15 mass % relative to the amount of the whole toner. The amount of the crystalline resin in such a range easily enables an enhancement in the transferability of a toner image.

Another binder resin different from the amorphous polyester resin and the crystalline resin may be used in combination as the binder resin. The amount of such another resin is suitably 10 mass % or less relative to the amount of the whole binder resin.

Examples of such another binder resin include vinyl resins that are homopolymers of monomers such as styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

Other examples of such another binder resin include non-vinyl resins such as epoxy resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins.

The amount of the binder resin is, for instance, preferably from 40 mass % to 95 mass %, more preferably from 50 mass % to 90 mass %, and further preferably from 60 mass % to 85 mass % relative to the amount of the whole toner particles.

Colorant

Examples of the colorant include a variety of pigments, such as carbon black, chrome yellow, Hansa Yellow, benzidine yellow, indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, and malachite green oxalate, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination.

The colorant may be optionally a surface-treated colorant or may be used in combination with a dispersant. Different types of colorants may be used in combination.

The amount of the colorant is, for instance, preferably from 1 mass % to 30 mass %, and more preferably from 3 mass % to 15 mass % relative to the amount of the whole toner particles.

Release Agent

Examples of a release gent include, but are not limited to, hydrocarbon waxes; natural waxes such as a carnauba wax, a rice bran wax, and a candelilla wax; synthetic or mineral/petroleum waxes such as a montan wax; and ester waxes such as a fatty acid ester and a montanic acid ester.

The melting temperature of the release agent is preferably from 50° C. to 110° C., and more preferably from 60° C. to 100° C.

The melting temperature is determined from a DSC curve obtained by differential scanning calorimetry (DSC) in accordance with "Melting Peak Temperature" described in determination of melting temperature in JIS K 7121-1987 "Testing Methods for Transition Temperatures of Plastics".

The amount of the release agent is, for example, preferably from 1 mass % to 20 mass %, and more preferably from 5 mass % to 15 mass % relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

In the case where the toner particles are analyzed by infrared absorption spectrometry, the ratio of absorbance for a wavelength of 1500 $cm^{-1}$ to absorbance for a wavelength of 720 $cm^{-1}$ is 0.6 or less (preferably 0.5 or less, and more preferably 0.48 or less), and the ratio of absorbance for a wavelength of 820 $cm^{-1}$ to absorbance for a wavelength of 720 $cm^{-1}$ is 0.4 or less (preferably 0.3 or less, and more preferably 0.2 or less).

The toner particles exhibit such infrared absorption spectrum characteristics when the polyhydric alcohol component contained in the amorphous polyester resin as the binder resin does not contain an alkylene oxide adduct of bisphenol A or contain it in a slight amount if any as described above.

In the analysis of the toner particles by infrared absorption spectrometry, the ratio of absorbance for a wavelength of 1500 $cm^{-1}$ to absorbance for a wavelength of 720 $cm^{-1}$ may be 0.2 or more (suitably 0.3 or more), and the ratio of absorbance for a wavelength of 820 $cm^{-1}$ to absorbance for a wavelength of 720 $cm^{-1}$ is 0.05 or more (suitably 0.08 or more) in terms of the storage stability of the toner.

In the analysis of the toner particles by infrared absorption spectrometry, the ratio of absorbance for a wavelength of 820 $cm^{-1}$ to absorbance for a wavelength of 1500 $cm^{-1}$ may be 0.5 or less (preferably 0.4 or less, and more preferably 0.35 or less) in terms of the strength of the toner particles.

In the analysis of the toner particles by infrared absorption spectrometry, the ratio of absorbance for a wavelength of 820 $cm^{-1}$ to absorbance for a wavelength of 1500 $cm^{-1}$ may be 0.1 or more (suitably 0.15 or more) in terms of the storage stability of the toner.

The absorbance for the individual wavelengths is measured by infrared absorption spectrometry as follows. Toner particles (or toner) that are to be analyzed are formed into a test sample by a KBr pellet technique. The test sample is analyzed in the wavelength range of 500 $cm^{-1}$ to 4000 $cm^{-1}$ with an infrared spectrophotometer (FT-IR-410 manufactured by JASCO Corporation) at number of integration of 300 times and resolution of 4 $cm^{-1}$. Baseline correction is carried out at, for instance, an offset part having no light absorption to determine the absorbance for the individual wavelengths.

In the case where the THF-soluble component of the toner particles is subjected to a GPC analysis to determine a weight average molecular weight Mw and a number average molecular weight Mn, Mw is from 25,000 to 60,000 (preferably from 30000 to 50000, and more preferably from 32000 to 48000), and Mw/Mn is from 5 to 10 (preferably from 6 to 8, and more preferably from 6.2 to 7.8).

Such molecular weight characteristics of the toner particles enable an enhancement in the fixability of a fixed image even in the case of using the toner of which the toner particles contain the amorphous polyester resin in which an alkylene oxide adduct of bisphenol A is not used or used in a slight amount as described above.

The peak molecular weight in the molecular weight distribution curve obtained by the GPC analysis of the THF-soluble component of the toner particles is preferably from 7,000 to 11,000, more preferably from 8,000 to 11,000, and further preferably from 8,200 to 10,500.

At a peak molecular weight in such a range, the fixability of a fixed image can be easily enhanced even in the case of using the toner of which the toner particles contain the amorphous polyester resin in which an alkylene oxide adduct of bisphenol A is not used or used in a slight amount.

In the case where a molecular weight distribution curve obtained by the GPC analysis of the THF-soluble component of the toner particles has multiple peaks, the term "peak molecular weight" refers to the molecular weight at the highest peak.

In the GPC analysis of the THF-soluble component of the toner particles, the molecular weight distribution curve, the average molecular weights, and the peak molecular weight are determined as follows.

Into 1 g of tetrahydrofuran (THF), 0.5 mg of toner particles (or toner) that are to be analyzed are dissolved. The solution is subjected to ultrasonic dispersion, the concentration of the toner particles is adjusted to be 0.5%, and then the dissolved component thereof is analyzed by GPC.

A GPC apparatus to be used is "HLC-8120GPC, SC-8020 (manufactured by Tosoh Corporation)", two columns of "TSKgel, SUPERHM-H (manufactured by Tosoh Corporation, 6.0 mm ID×15 cm)" are used, and THF is used as an eluent. The concentration of the sample is 0.5%, the flow rate is 0.6 ml/min, the injection amount of the sample is 10 μl, the measurement temperature is 40° C., and a refractive index (RI) detector is used. The calibration curve is determined from 10 samples of "polystyrene standard sample of TSK standard" manufactured by Tosoh Corporation: "A-500", "F-1", "F-10", "F-80", "F-380", "A-2500", "F-4", "F-40", "F-128", and "F-700".

The amount of the toluene-insoluble component of the toner particles is preferably from 25 mass % to 45 mass %, more preferably from 28 mass % to 38 mass %, and further preferably from 30 mass % to 35 mass %.

At an amount of the toluene-insoluble component of the toner particles in such a range, the moisture absorption of the toner particles is lowered, which easily leads to an enhancement in the transferability of a toner image.

The toluene-insoluble component of the toner particles refers to the component that is contained in the toner particles but not dissolved in toluene. In other words, the toluene-insoluble component is an insoluble matter of which the principle component (for instance, 50 mass % or more of the whole) is a component of the binder resin that is not dissolved in toluene (particularly high-molecular-weight component of binder resin). The amount of the toluene-insoluble component can be an index of the cross-linked resin content in the toner.

The amount of the toluene-insoluble component is measured as follows.

Toner particles (or toner) weighed to 1 g are put into weighed cylindrical filter paper made of glass fibers, and this cylindrical filter paper is attached to the extraction tube of a thermal Soxhlet extractor. Toluene is put into a flask and heated to 110° C. with a mantle heater. A heater attached to the extraction tube is used to heat the surrounding of the extraction tube to 125° C. The extraction is performed at such a reflux rate that a single cycle of extraction is in the range of four minutes to five minutes. After the extraction is performed for 10 hours, the cylindrical paper filter and residual toner are retrieved, dried, and weighed.

Then, the amount (mass %) of the toner particle residue (or toner residue) is calculated on the basis of the following equation and defined as the amount of the toluene-insoluble component (mass %).

amount(mass %) of toner particle residue(or toner residue)=[(weight of cylindrical filter paper+weight of residual toner)(g)−weight of cylindrical filter paper(g)]−mass(g) of toner particles(or toner)×100 Equation:

The toner particle residue (or toner residue) contains, for example, a colorant, an inorganic substance such as an external additive, and the high-molecular-weight component of the binder resin. In the case where toner particles contain a release agent, the release agent is a toluene-soluble component because the extraction is carried out through heating.

The toluene-insoluble component of the toner particles is, for example, adjusted by (1) adding a cross-linking agent to a high-molecular-weight component having a reactive functional group at its end to form a cross-linked structure or a branched structure in the binder resin, (2) using a polyvalent metal ion in the binder resin to form a cross-linked structure or a branched structure in a high-molecular-weight component having an ionic functional group at its end, or (3) using, for instance, isocyanate in the binder resin to extend the chain structure of the resin or to allow it to branch.

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50v) of the toner particles is preferably from 2 μm to 10 μm, and more preferably from 4 μm to 8 μm.

The average particle size of the toner particles and the index of the particle size distribution thereof are measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of an aqueous solution of a 5% surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size D16v and a number particle size D16p, while the particle size for a cumulative percentage of 50% is defined as a volume average particle size D50v and a number average particle size D50p. Furthermore, the particle size for a cumulative percentage of 84% is defined as a volume particle size D84v and a number particle size D84p.

From these particle sizes, the index of the volume particle size distribution (GSDv) is calculated as $(D84v/D16v)^{1/2}$, while the index of the number particle size distribution (GSDp) is calculated as $(D84p/D16p)^{1/2}$.

The average circularity of the toner particles is preferably from 0.94 to 1.00, and more preferably from 0.95 to 0.98.

The average circularity of the toner particles is determined from (circle-equivalent circumference)/(circumference) [circumference of circle having the same projection area as image of particle]/(circumference of projection image of particle)]. In particular, the average circularity of the toner particles is determined as follows.

The toner particles that are to be analyzed are collected by being sucked and allowed to flow in a flat stream. An image of the particles is taken as a still image by instant emission of stroboscopic light and then analyzed with a flow particle image analyzer (FPIA-3000 manufactured by SYSMEX CORPORATION). The number of samples used to determine the average circularity is 3500.

In the case where the toner contains an external additive, the toner (developer) to be analyzed is dispersed in water containing a surfactant and then subjected to an ultrasonic treatment to obtain toner particles having no external additive content.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high-molecular-weight fluorine material).

The amount of the external additive to be used is, for example, preferably from 0.01 mass % to 5 mass %, and more preferably from 0.01 mass % to 2.0 mass % relative to the amount of the toner particles.

Production of Toner

Production of the toner used in the exemplary embodiment will now be described.

The toner used in the exemplary embodiment can be produced by preparing toner particles and then externally adding an external additive to the toner particles.

The toner particles may be produced by any of a dry process (such as kneading pulverizing method) and a wet process (such as aggregation coalescence method, suspension polymerization method, or dissolution suspension method). Production of the toner particles is not particularly limited to these production processes, and any of known techniques can be employed.

The toner used in the exemplary embodiment is produced, for example, by adding an external additive to the produced toner particles being in a dried state and then mixing them with each other. The mixing may be carried out, for instance, with a V blender, a HENSCHEL MIXER, or a Loedige mixer. Furthermore, a vibratory sieving machine or a wind sieving machine may be optionally used to remove the coarse particles of the toner.

Carrier

A carrier is not particularly limited, and any of known carriers can be used. Examples of the carrier include coated carriers in which the surface of a core formed of magnetic powder have been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably from 1:100 to 30:100, and more preferably from 3:100 to 20:100.

EXAMPLES

The exemplary embodiment of the invention will now be further specifically described in detail with reference to Examples and Comparative Examples but is not limited thereto at all.

Preparation of Amorphous Polyester Resin

Preparation of Amorphous Polyester Resin (A1)

Into a three-neck flask of which the inside has been dried, 60 parts by mass of dimethyl terephthalate, 74 parts by mass of dimethyl fumarate, 30 parts by mass of dodecenylsuccinic anhydride, 22 parts by mass of trimellitic acid, 138 parts by mass of propylene glycol, and 0.3 parts by mass of dibutyltin oxide are put. The mixture is reacted at 185° C. for 3 hours under nitrogen atmosphere while removing water generated during the reaction to the outside. Then, the temperature is increased up to 240° C. while the pressure is gradually reduced, and the resulting product is further reacted for 4 hours and then cooled. Through this process, an amorphous polyester resin (A1) having a weight average molecular weight of 39,000 is prepared.

Preparation of Amorphous Polyester Resin (A2)

An amorphous resin (A2) is prepared in the same manner as in the preparation of the amorphous resin (A1) except for the following changes: the reaction is performed at 190° C. for 3 hours, the temperature is subsequently increased up to 220° C. while the pressure is gradually reduced, and the resulting product is further reacted for 2.5 hours. The weight average molecular weight of the amorphous polyester resin (A2) is 26,000.

Preparation of Amorphous Polyester Resin (A3)

An amorphous resin (A3) is prepared in the same manner as in the preparation of the amorphous resin (A1) except for the following changes: 138 parts by mass of the propylene glycol is changed to 128 parts by mass of propylene glycol and 19 parts by mass of butylene glycol, the reaction is performed at 195° C. for 4 hours, the temperature is subsequently increased up to 240° C. while the pressure is gradually reduced, and the resulting product is further reacted for 6 hours. The weight average molecular weight of the amorphous polyester resin (A3) is 56,000.

Preparation of Crystalline Resin

Preparation of Crystalline Polyester Resin (B1)

Into a three-neck flask, 100 parts by mass of dimethyl sebacate, 67.8 parts by mass of hexanediol, and 0.10 parts by mass of dibutyltin oxide are put. The mixture is reacted at 185° C. for 5 hours under nitrogen atmosphere while removing water generated in the reaction to the outside. Then, the temperature is increased up to 220° C. while the pressure is gradually reduced, and the resulting product is further reacted for 6 hours and then cooled. Through this process, a crystalline polyester resin (B1) having a weight average molecular weight of 33,700 is prepared.

The melting temperature of the crystalline polyester resin (B1) is determined from a DSC curve obtained by differential scanning calorimetry (DSC) in accordance with "Melting Peak Temperature" described in determination of melting temperature in JIS K 7121-1987 "Testing Methods for Transition Temperatures of Plastics". The melting temperature is 71° C.

Preparation of Referential Amorphous Polyester Resin

Preparation of Referential Amorphous Polyester Resin (C1)

An amorphous resin (C1) is prepared in the same manner as in the preparation of the amorphous resin (A1) except that the composition of the components are changed to 60 parts by mass of dimethyl terephthalate, 74 parts by mass of dimethyl fumarate, 30 parts by mass of dodecenylsuccinic anhydride, 22 parts by mass of trimellitic acid, 137 parts by mass of an ethylene oxide adduct of bisphenol A, 191 parts by mass of a propylene oxide adduct of bisphenol A, and 0.3 parts by mass of dibutyltin oxide. The weight average molecular weight of the referential amorphous polyester resin (C1) is 27,000.

Production of Toner

Production of Toner (1)

Into a HENSCHEL MIXER (manufactured by NIPPON COKE & ENGINEERING CO., LTD.), 73 parts by mass of the amorphous polyester resin (A1), 6 parts by mass of the crystalline polyester resin (B1), 7 parts by mass of a colorant (C.I. Pigment Red 122), 5 parts by mass of a release agent (paraffin wax manufactured by NIPPON SEIRO CO., LTD., melting temperature of 73° C.), and 2 parts by mass of ester wax (behenyl behenate, UNISTER M-2222SL manufactured by NOF CORPORATION) are put. The mixture is stirred and mixed at a rotational speed of 15 m/s for 5 minutes, and the resulting mixture is melt-kneaded with an extruder-type continuous kneader.

In the extruder-type continuous kneader, the temperature is 160° C. on the supply side and 130° C. on the discharge side, the temperature of a cooling roller is 40° C. on the supply side and 25° C. on the discharge side. The temperature of a cooling belt is adjusted to be 10° C.

The melt-kneaded product is cooled, then roughly pulverized with a hammer mill, and subsequently finely pulverized with a jet-type pulverizer (manufactured by Nippon Pneumatic Mfg. Co., Ltd.) to 6.5 μm. The resulting product is classified with an elbow-jet classifier (type: EJ-LABO, manufactured by Nittetsu Mining Co., Ltd.) to yield toner particles (1). The toner particles (1) have a volume average particle size of 7.0 μm.

Then, 100 parts by mass of the toner particles (1) and 1.2 parts by mass of an external additive that is a commercially available fumed silica RX50 (manufactured by NIPPON AEROSIL CO., LTD.) are mixed with each other with a HENSHEL MIXER (manufactured by MITSUI MIIKE MACHINERY Co., Ltd.) at a rotational speed of 30 m/s for 5 minutes, thereby obtaining toner (1).

Production of Toner (2)

A toner (2) is prepared in the same manner as in the preparation of the toner (1) except that the amorphous polyester resin (A2) is used in place of the amorphous polyester resin (A1). The toner particles (2) have a volume average particle size of 6.8 μm.

Except that the toner particles (2) replaces the toner particles (1), toner (2) is produced as in the production of the toner (1).

Production of Toner (3)

A toner (3) is prepared in the same manner as in the preparation of the toner (1) except that the amorphous polyester resin (A3) is used in place of the amorphous polyester resin (A1). The toner particles (3) have a volume average particle size of 7.5 μm.

Except that the toner particles (3) replaces the toner particles (1), toner (3) is produced as in the production of the toner (1).

Production of Toner (4)

A toner (4) is prepared in the same manner as in the preparation of the toner (1) except that the amount of the amorphous polyester resin (A1) is changed to 79 parts by mass and that the crystalline polyester resin (B1) is not used. The toner particles (4) have a volume average particle size of 7.1 μm.

Except that the toner particles (4) replaces the toner particles (1), toner (4) is produced as in the production of the toner (1).

Production of Referential Toner (C1)

A toner (C1) is prepared in the same manner as in the preparation of the toner (4) except that the referential amorphous polyester resin (C1) is used in place of the amorphous polyester resin (A1). The referential toner particles (C1) have a volume average particle size of 7.7 μm.

Except that the referential toner particles (C1) replaces the toner particles (1), toner (C1) is produced as in the production of the toner (1).

Production of Developer

Developers (1) to (4) and Referential Developer (C1) With 100 parts by mass of a carrier, 8 parts by mass of the individual toners are separately mixed to produce developers (1) to (4) and a referential developer (C1).

In order to produce the carrier, 14 parts by mass of toluene and 2 parts by mass of a styrene-methyl methacrylate copolymer (component ratio: styrene/methyl methacrylate=90/10, weight average molecular weight Mw: 80,000) are stirred for 10 minutes with a stirrer to prepare a coating liquid in which these materials have been dispersed. The coating liquid and 100 parts by mass of ferrite particles (volume average particle size: 50 μm) are put into a vacuum degassing kneader (manufactured by INOUE MFG., INC.) and stirred at 60° C. for 30 minutes. Then, the pressure is reduced for degassing under heating to dry the resulting product, and the dried product is filtered with a 105-μm sieve to yield the carrier.

Analyses

Each of the toners is subjected to analysis of the molecular weight characteristics of the toner particles, analysis of the infrared absorption spectrum characteristics of the toner particles, and analysis of the toluene-insoluble component in the manners described above. Table 1 shows results of the analyses.

Examples 1 to 4

Preparation of Image Forming Apparatus (1)

An image forming apparatus (trade name: Color 1000 Press, manufactured by Fuji Xerox Co., Ltd.) is prepared. This image forming apparatus has an intermediate transfer belt; namely, it is an intermediate transfer type. The transfer member has the structure illustrated in FIG. 2; in particular, it includes a first transfer roller disposed downstream of the reference position (position at which the photoreceptor contacts the intermediate transfer belt being in an unbent state) in the driving direction of the intermediate transfer belt (disposed at an offset position).

The intermediate transfer belt is a semiconductive belt member formed of a polyimide resin and containing carbon black.

In the image forming apparatus (1), the width of the nip is 7 mm at the first transfer position.

A transfer bias that is a direct-current voltage is applied by the first transfer roller.

Developers containing the toners (1) to (4) as shown in Table 1 are used in the developing device of the image forming apparatus.

Examples 5 to 8

Preparation of Image Forming Apparatus (2)

An image forming apparatus (2) is prepared as in the preparation of the image forming apparatus (1) except that the transfer bias applied by the first transfer roller is changed to a superimposed voltage in which a direct-current voltage has been superimposed on an alternating-current voltage.

Developers containing the toners (1) to (4) as shown in Table 1 are used in the developing device of the image forming apparatus.

Comparative Examples 1 to 4 and Reference Example

Preparation of Comparative Image Forming Apparatus (C1)

An image forming apparatus (C1) is prepared as in the preparation of the image forming apparatus (1) except that the first transfer roller (transfer member) is disposed at the reference position (position at which the photoreceptor contacts the intermediate transfer belt being in an unbent state), and the belt member is not winding around the transfer member and the image holding member.

In the image forming apparatus (C1), the width of the nip is 3 mm at the first transfer position.

Developers containing the toners (1) to (4) or the referential toner (C1) as shown in Table 1 are used in the developing device of the image forming apparatus.

Evaluations

Fixability and Hot Offset

Fixability is evaluated as follows.

An image forming apparatus in which a two-component developer is used is prepared by modifying an image forming apparatus "DOCUCENTER COLOR 500" (manufactured by Fuji Xerox Co., Ltd., fixing temperature: 220° C., and image forming rate: 250 mm/s). The developers are individually put into the developing unit of the image forming apparatus, and 20 sheets of recording paper (type P paper manufactured by Fuji Xerox Co., Ltd.) on which an image having a width of 20 mm in the paper transporting direction and an image density of 100% has been formed are output. The image is evaluated on the basis of the below criteria.

In Examples 1 to 4, the transfer member has the structure illustrated in FIG. 2; in particular, it includes a first transfer roller disposed downstream of the reference position (position at which the photoreceptor contacts the intermediate transfer belt being in an unbent state) in the driving direction of the intermediate transfer belt (disposed at an offset position). In the image forming apparatus, the width of the nip is 7 mm at the first transfer position. The intermediate transfer belt is winding around the photoreceptor and first transfer roller and is a semiconductive belt member formed of a polyimide resin and containing carbon black. A transfer bias that is a direct-current voltage is applied by the first transfer roller.

In Examples 5 to 8, the transfer bias applied by the first transfer roller in Examples 1 to 4 is changed to a superimposed voltage in which a direct-current voltage has been superimposed on an alternating-current voltage.

In Comparative Examples 1 to 4 and Reference Example, the first transfer roller (transfer member) used in Examples 1 to 4 is disposed at the reference position (position at which the photoreceptor contacts the intermediate transfer belt being in an unbent state). The width of the nip is 3 mm at the first transfer position.

The evaluation criteria are as follows.

A: Excellent

B: Good

Transferability

The above-mentioned image forming apparatus is used to evaluate transferability in a high temperature and high humidity environment (35° C., 85%) as follows.

A 100% solid patch is formed on the image holding member (photoreceptor) and transferred onto the intermediate transfer belt. Then, the mass of the patch on the photoreceptor and the mass of the patch on the intermediate transfer belt are measured. Transfer efficiency (%) is defined as "mass of toner on intermediate transfer belt/mass of toner on photoreceptor×100", and transferability is evaluated on the basis of the transfer efficiency.

The evaluation criteria are as follows.

A: Transfer efficiency of 98% or more

B: Transfer efficiency of 95% or more but less than 98%

C: Transfer efficiency of 90% or more but less than 95%

D: Transfer efficiency of less than 90%

TABLE 1

| | Developer (toner) | | | | | | | | | | | | |
|---|---|---|---|---|---|---|---|---|---|---|---|---|---|
| | | | Molecular weight characteristics of toner particles | | | | Infrared absorption spectrum characteristics of toner particles | | | | | | Toluene-insoluble component of toner particles (mass %) |
| | Type | Binder resin | Mw | Mn | Mw/Mn | Peak molecular weight | Absorbance A for wavelength of 1500 $cm^{-1}$ | Absorbance B for wavelength of 820 $cm^{-1}$ | Absorbance C for wavelength of 720 $cm^{-1}$ | A/C | B/C | B/A | |
| Example 1 | (1) | (A1) + (B1) | 37000 | 5000 | 7.4 | 9500 | 0.07 | 0.02 | 0.15 | 0.47 | 0.13 | 0.29 | 34 |
| Example 2 | (2) | (A2) + (B1) | 25000 | 3000 | 8.3 | 7000 | 0.12 | 0.04 | 0.20 | 0.60 | 0.20 | 0.33 | 28 |
| Example 3 | (3) | (A3) + (B1) | 60000 | 8500 | 7.1 | 11000 | 0.05 | 0.02 | 0.11 | 0.45 | 0.18 | 0.40 | 38 |
| Example 4 | (4) | (A1) | 39000 | 4500 | 8.7 | 9800 | 0.08 | 0.02 | 0.14 | 0.57 | 0.14 | 0.25 | 33 |
| Example 5 | (1) | (A1) + (B1) | 37000 | 5000 | 7.4 | 9500 | 0.07 | 0.02 | 0.15 | 0.47 | 0.13 | 0.29 | 34 |
| Example 6 | (2) | (A2) + (B1) | 25000 | 3000 | 8.3 | 7000 | 0.12 | 0.04 | 0.20 | 0.60 | 0.20 | 0.33 | 28 |
| Example 7 | (3) | (A3) + (B1) | 60000 | 8500 | 7.1 | 11000 | 0.05 | 0.02 | 0.11 | 0.45 | 0.18 | 0.40 | 38 |
| Example 8 | (4) | (A1) | 39000 | 4500 | 8.7 | 9800 | 0.08 | 0.02 | 0.14 | 0.57 | 0.14 | 0.25 | 33 |
| Comparative Example 1 | (1) | (A1) + (B1) | 37000 | 5000 | 7.4 | 9500 | 0.07 | 0.02 | 0.15 | 0.47 | 0.13 | 0.29 | 34 |
| Comparative Example 2 | (2) | (A2) + (B1) | 25000 | 3000 | 8.3 | 7000 | 0.12 | 0.04 | 0.20 | 0.60 | 0.20 | 0.33 | 28 |
| Comparative Example 3 | (3) | (A3) + (B1) | 60000 | 8500 | 7.1 | 11000 | 0.05 | 0.02 | 0.11 | 0.45 | 0.18 | 0.40 | 38 |
| Comparative Example 4 | (4) | (A1) | 39000 | 4500 | 8.7 | 9800 | 0.08 | 0.02 | 0.14 | 0.57 | 0.14 | 0.25 | 33 |
| Reference Example | (C1) | (C1) | 27000 | 5000 | 5.4 | 7500 | 0.90 | 0.50 | 0.30 | 3.00 | 1.67 | 0.56 | 31 |

TABLE 2

| | Developer (toner) | Image forming apparatus | | | | Evaluations | |
|---|---|---|---|---|---|---|---|
| | Type | Type | Position of first transfer roller | Width of nip (mm) | Applied voltage (transfer bias) | Fixability | Transferability |
| Example 1 | (1) | (1) | Offset | 7 | DC voltage | A | B |
| Example 2 | (2) | (1) | Offset | 7 | DC voltage | B | B |
| Example 3 | (3) | (1) | Offset | 7 | DC voltage | B | B |
| Example 4 | (4) | (1) | Offset | 7 | DC voltage | B | B |
| Example 5 | (1) | (2) | Offset | 7 | Superimposed voltage | A | A |
| Example 6 | (2) | (2) | Offset | 7 | Superimposed voltage | B | A |
| Example 7 | (3) | (2) | Offset | 7 | Superimposed voltage | B | A |
| Example 8 | (4) | (2) | Offset | 7 | Superimposed voltage | B | A |
| Comparative Example 1 | (1) | (C1) | Only reference position | 3 | DC voltage | A | C |
| Comparative Example 2 | (2) | (C1) | Only reference position | 3 | DC voltage | B | D |
| Comparative Example 3 | (3) | (C1) | Only reference position | 3 | DC voltage | B | C |
| Comparative Example 4 | (4) | (C1) | Only reference position | 3 | DC voltage | B | C |
| Reference Example | (C1) | (C1) | Only reference position | 3 | DC voltage | B | B |

As is obvious from the results shown in the table, the image forming apparatuses of Examples have higher transferability of a toner image in a high temperature and high humidity environment than the image forming apparatuses of Comparative Examples. In the image forming apparatuses of Examples, a specific toner is used, and the transfer member (first transfer roller) is disposed so as to bend part of the intermediate transfer belt as the belt member to form a contact region (nip) at which the bent part of the intermediate transfer belt contacts part of the image holding member (photoreceptor) along the circumference of the image holding member. So, the intermediate transfer belt is winding around the photoreceptor and first transfer roller; in the image forming apparatuses of Comparative Examples, merely the transfer member (first transfer roller) disposed at the reference position is used.

The image forming apparatus of Reference Example is an example using toner which contains an amorphous polyester resin in which an alkylene oxide adduct of bisphenol A is used. In the image forming apparatus of Reference Example, the transferability of a toner image is less likely to be reduced although merely the transfer member (first transfer roller) disposed at the reference position is used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging device that charges a surface of the image holding member;

an electrostatic charge image forming device that forms an electrostatic charge image on the charged surface of the image holding member;

a developing device that has an electrostatic charge image developer containing an electrostatic charge image developing toner and that develops the electrostatic charge image to form a toner image on the surface of the image holding member; and a transfer device that transfers the toner image onto a recording medium, wherein the transfer device includes a belt member and a transfer member, the belt member has an outer surface that contacts the image holding member, and the belt member winds around the image holding member and the transfer member;

the toner has a binder resin containing an amorphous polyester resin in which an amount of an alkylene oxide adduct of bisphenol A, if present, is not more than 5 mol %, relative to a total amount of polyhydric alcohols;

a tetrahydrofuran-soluble component of the toner has a weight average molecular weight Mw and a number average molecular weight Mn determined from gel permeation chromatography, the Mw is in the range of 25,000 to 60,000, and Mw/Mn is in the range of 5 to 10; and the toner has absorbances measured by infrared absorption spectrometry, a ratio of an absorbance at a wavelength of 1500 $cm^{-1}$ to an absorbance at a wavelength of 720 $cm^{-1}$ is 0.6 or less, and a ratio of an absorbance at a wavelength of 820 $cm^{-1}$ to the absorbance at the wavelength of 720 $cm^{-1}$ is 0.4 or less.

2. The image forming apparatus according to claim 1, wherein the ratio of the absorbance at the wavelength of 1500 $cm^{-1}$ to the absorbance at the wavelength of 720 $cm^{-1}$ is 0.5 or less, and the ratio of the absorbance at the wavelength of 820 $cm^{-1}$ to the absorbance at the wavelength of 720 $cm^{-1}$ is 0.3 or less.

3. The image forming apparatus according to claim 1, wherein the ratio of the absorbance at the wavelength of 1500 $cm^{-1}$ to the absorbance at the wavelength of 720 $cm^{-1}$ is 0.2 or more, and the ratio of the absorbance at the wavelength of 820 $cm^{-1}$ to the absorbance at the wavelength of 720 $cm^{-1}$ is 0.05 or more.

4. The image forming apparatus according to claim 1, wherein a ratio of the absorbance at the wavelength of 820 $cm^{-1}$ to the absorbance at the wavelength of 1500 $cm^{-1}$ is 0.5 or less.

5. The image forming apparatus according to claim 1, wherein the ratio of the absorbance at the wavelength of 820 $cm^{-1}$ to the absorbance at the wavelength of 1500 $cm^{-1}$ is 0.4 or less.

6. The image forming apparatus according to claim 1, wherein the tetrahydrofuran-soluble component of the toner has a peak molecular weight ranging from 7,000 to 11,000.

7. The image forming apparatus according to claim 1, wherein the tetrahydrofuran-soluble component of the toner has a peak molecular weight ranging from 8,000 to 11,000.

8. The image forming apparatus according to claim 1, wherein the toner further comprises a toluene-insoluble component in an amount from 28 mass % to 38 mass %.

9. The image forming apparatus according to claim 8, wherein the amount of the toluene-insoluble component is from 30 mass % to 35 mass %.

10. The image forming apparatus according to claim 1, wherein the toner contains a crystalline resin.

11. The image forming apparatus according to claim 10, wherein an amount of the crystalline resin is in a range of 3 mass % to 20 mass % relative to the amount of the whole toner.

12. The image forming apparatus according to claim 10, wherein the amount of the crystalline resin is in a range of 5 mass % to 15 mass % relative to the amount of the whole toner.

13. The image forming apparatus according to claim 1, wherein the transfer device includes a plurality of transfer members provided for one image holding member, and the transfer members are disposed so as to face the image holding member with the belt member interposed between the image holding member and the transfer members.

14. The image forming apparatus according to claim 13, wherein the transfer device includes a pressure belt that is placed around the plurality of the transfer members to apply pressure to the belt member in the direction of the image holding member.

15. The image forming apparatus according to claim 1, wherein a contact region in the transfer device has a length ranging from 5 mm to 60 mm in the driving direction of the belt member.

16. The image forming apparatus according to claim 1, wherein the transfer member of the transfer device applies a transfer bias that is a superimposed voltage in which a direct-current voltage has been superimposed on an alternate-current voltage.

* * * * *